US006863580B2

(12) United States Patent
Okuyama

(10) Patent No.: US 6,863,580 B2
(45) Date of Patent: Mar. 8, 2005

(54) CONTROL CIRCUITS AND METHODS FOR INHIBITING ABRUPT ENGINE MODE TRANSITIONS IN A WATERCRAFT

(75) Inventor: Takashi Okuyama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/624,204

(22) Filed: Jul. 22, 2003

(65) Prior Publication Data

US 2004/0121661 A1 Jun. 24, 2004

(30) Foreign Application Priority Data

Jul. 22, 2002 (JP) ..... 2002-212900

(51) Int. Cl.[7] ..... B63H 21/22
(52) U.S. Cl. ..... 440/1; 440/84
(58) Field of Search ..... 440/1, 84, 86, 440/87

(56) References Cited

U.S. PATENT DOCUMENTS

| | | | | |
|---|---|---|---|---|
| 4,497,057 | A | 1/1985 | Kato et al. | |
| 4,566,415 | A | 1/1986 | Iwai et al. | 123/361 |
| 4,692,918 | A | 9/1987 | Elliott et al. | |
| 4,708,669 | A | 11/1987 | Kanno et al. | 440/1 |
| 4,759,731 | A | 7/1988 | Uchida et al. | 440/1 |
| 4,767,363 | A | 8/1988 | Uchida et al. | 440/1 |
| 4,796,206 | A | 1/1989 | Boscove et al. | |
| 4,817,466 | A | 4/1989 | Kawamura et al. | |
| 4,931,025 | A | 6/1990 | Torigai et al. | 440/1 |
| 5,031,562 | A | 7/1991 | Nakase et al. | |
| 5,230,643 | A | 7/1993 | Kanno | |
| 5,245,324 | A | 9/1993 | Jonker et al. | |
| 5,325,082 | A | 6/1994 | Rodriguez | |
| 5,352,138 | A | 10/1994 | Kanno | |
| 5,626,120 | A | 5/1997 | Akatsuka | 123/479 |

(List continued on next page.)

FOREIGN PATENT DOCUMENTS

| | | |
|---|---|---|
| EP | 0 962 871 A2 | 12/1999 |
| JP | 6-26878 | 4/1994 |
| JP | 10-011105 | 1/1998 |
| JP | 10-184429 | 7/1998 |
| JP | 10-184431 | 7/1998 |

(List continued on next page.)

OTHER PUBLICATIONS

International Standard; ISO 11783–5; Tractor and machinery for agriculture and forestry—Serial control and communications data network; Part 5: Network management; First edition May 1, 2001.

(List continued on next page.)

*Primary Examiner*—Stephen Avila
(74) *Attorney, Agent, or Firm*—Knobbe, Martens, Olson & Bear LLP.

(57) ABSTRACT

One embodiment of the present invention provides a control circuit and method for controlling the throttle valve position and shift mode of a watercraft's engine so as to reduce abrupt engine speed and shift mode transitions. The control circuit controls the actual shift mode (forward, reverse or neutral) and throttle valve position of the engine based on throttle and shift mode signals or commands generated by an operator via a control device, and based further upon the current shift mode and throttle valve position of the engine. When the operator abruptly adjusts the throttle, the control circuit more gradually adjusts the position of the throttle valve to smooth the transition in engine speed. The control circuit also delays operator-commanded transitions in the engine's shift mode, as necessary, so that changes in the engine's shift mode occur while the throttle valve is in the closed or nearly closed position.

29 Claims, 16 Drawing Sheets

U.S. PATENT DOCUMENTS

| | | | | | |
|---|---|---|---|---|---|
| 5,827,150 | A | * | 10/1998 | Mukumoto | 477/101 |
| 5,852,789 | A | | 12/1998 | Trsar et al. | |
| 5,904,604 | A | | 5/1999 | Suzuki et al. | |
| 5,935,187 | A | | 8/1999 | Trsar et al. | |
| 6,015,319 | A | | 1/2000 | Tanaka | 440/84 |
| 6,055,468 | A | | 4/2000 | Kaman et al. | |
| 6,086,435 | A | * | 7/2000 | Hoshiba et al. | 440/1 |
| 6,109,986 | A | | 8/2000 | Gaynor et al. | 440/87 |
| 6,141,608 | A | | 10/2000 | Rother | |
| 6,174,264 | B1 | | 1/2001 | Hoshiba et al. | 477/102 |
| 6,216,083 | B1 | | 4/2001 | Ulyanov et al. | |
| 6,325,046 | B1 | | 12/2001 | Kanno | 123/406.44 |
| 6,330,553 | B1 | | 12/2001 | Uchikawa et al. | |
| 6,415,766 | B1 | | 7/2002 | Kanno et al. | 123/339.19 |
| 6,431,930 | B1 | | 8/2002 | Holt | |
| 6,529,816 | B1 | | 3/2003 | Yamaguchi et al. | |
| 6,603,278 | B2 | * | 8/2003 | Oshima et al. | 318/139 |
| 2001/0049579 | A1 | | 12/2001 | Fujino et al. | |

FOREIGN PATENT DOCUMENTS

| | | |
|---|---|---|
| JP | 11-343916 | 12/1999 |
| JP | 2000-076300 | 3/2000 |
| JP | 2000-108995 | 4/2000 |
| JP | 2000-313398 | 11/2000 |
| JP | 2001-119416 | 4/2001 |

OTHER PUBLICATIONS

Co–pending U.S. Appl. No.: 10/251,722; filed Sep. 20, 2002, entitled "Engine Control System for Watercraft," inventor Isao Kanno, assigned to Sanshin Kogyo Kabushiki Kaisha.

Co–pending U.S. Appl. No.: 10/247,919; filed Sep. 20, 2002, entitled "Inspection System For Watercraft," inventors Takashi Okuyama and Isao Kanno, assigned to Sanshin Kogyo Kabushiki Kaisha.

Co–pending U.S. Appl. No.: 10/255,042; filed Sep. 25, 2002, entitled "Diagnostic System For Watercraft," inventors Isao Kanno and Hitoshi Motose, assigned to Sanshin Kogyo Kabushiki Kaisha.

Co–pending U.S. Appl. No.: 10/254,818; filed Sep. 25, 2002, entitled "Watercraft Management System," inventors Takashi Okuyama and Hitoshi Motose, assigned to Sanshin Kogyo Kabushiki Kaisha.

Co–pending U.S. Appl. No.: 10/280,262; filed Oct. 24, 2002, entitiled "Watercraft Control Systems," inventors Isao Kanno and Takashi Okuyama, assigned to Sanshin Kogyo Kabushiki Kaisha.

Co–pending U.S. Appl. No.: 10/281,390; filed Oct. 24,2002, entitled "Small Watercraft And Outboard Motor," inventor Isao Kanno, assigned to Sanshin Kogyo Kabishiki Kaisha.

Co–pending US application No: ; filed Jul. 11, 2003, entitled "Multiple Node Network and Communication Method Within the Network," inventor Takashi Okuyama.

Co–pending US application No: ; filed Jul. 22, 2003 entitled "Engine Starting System for Multiple Engines," inventor Takashi Okuyama.

NMEA 2000; Standard for Serial Data Networking of Marine Electronic Devices; Main Document; Version 1.000, Sep. 12, 2001; @NMEA 1999, 2000, 2001.

NMEA 2000; Standard for Serial Data Networking of Marine Electronic Devices; Appendix A; Version 1.000; Sep. 12, 2001; @NMEA 1999, 2000, 2001.

NMEA 2000; Standard for Serial Data Networking of Marine Electronic Devices; Appendix B; @NMEWA 1999, 2000, 2001.

NMEA 2000; Standard for Serial Data Networking of Marine Electronic Devices; Appendix C; Version 1.000, Sep.12, 2001, @NMEA 1999, 2000, 2001.

NMEA 2000; Standard for Serial Data Networking of Marine Electronic Devices; Appendix D; Version 1.000, Sep. 12, 2001, @NMEA 1999, 2000, 2001.

NMEA 2000; Standard for Serial Data Networking of Marine Electronic Devices; Appendix E; ISO 11783–5 Network Management.

NMEA 2000; Standard for Serial Data Networking of Marine Electronic Devices; Appendix F; ISO 11783–3 DataLink Layer.

NMEA 2000; Standard for Serial Data Networking of Marine Electronic Devices; Appendix G; ISO 11898 Controller Area Network.

* cited by examiner

CONTROL CIRCUITS AND METHODS FOR INHIBITING ABRUPT ENGINE MODE TRANSITIONS IN A WATERCRAFT

PRIORITY INFORMATION

The present application is based on and claims priority under 35 U.S.C. § 119 to Japanese Patent Application No. 2002-212900, filed on Jul. 22, 2002, the entire content of which is expressly incorporated by reference herein.

BACKGROUND OF THE INVENTION

1. Field of the Invention

The present invention generally relates to a watercraft with a propulsion device and an engine, and more particularly relates to control circuits and methods for controlling the throttle and shift mode settings of an engine.

2. Description of Related Art

Computerized controls have become popular in recent years for watercrafts. In one arrangement of the watercrafts, a propulsion device propels the watercraft and an engine powers the propulsion device. A remote controller and a control device are provided to remotely control the propulsion device and the engine. For instance, some of such computerized controls are disclosed in U.S. Pat. No. 6,431,930 (corresponding to JP2000-108995) and JP2000-313398.

In a typical example, an outboard motor incorporates the propulsion device and the engine. The propulsion device of the outboard motor can be, for example, a propeller that is rotatably coupled with a crankshaft of the engine through a driveshaft and a propeller shaft. The outboard motor can have a changeover mechanism that changes the propeller among forward, neutral and reverse modes. The watercraft proceeds forwardly when the propeller is in the forward mode and rotates in a right direction, and proceeds backwardly when the propeller is in the reverse mode and rotates in a reverse direction. The watercraft is not propelled when the propeller is in the neutral mode and does not rotate.

The engine of the outboard motor can be provided with an air intake device that introduces air to a combustion chamber of the engine. The intake device can have a throttle valve that moves between a fully closed position and a fully open position to regulates an amount of the air. The intake device introduces a relatively small amount of air when the throttle valve is in the fully closed position or adjacent to the fully closed position, while the intake device introduces a relatively large amount of air when the throttle valve is in the fully open position or adjacent to the fully open position.

The remote controller is operable by an operator so as to input a desired mode of the propeller and a desired throttle valve position to the control device. The control device can control the changeover mechanism and the throttle valve position by actuators based upon the desired mode and the desired throttle valve position, respectively.

In the conventional controls, however, an abnormal mode change or a discomfort shock can occur.

SUMMARY OF THE INVENTION

One embodiment of the present invention provides a control circuit and method for controlling the throttle valve position and shift mode of a watercraft's engine so as to reduce abrupt engine speed and shift mode transitions. The control circuit controls the actual shift mode (forward, reverse or neutral) and throttle valve position of the engine based on throttle and shift mode signals or commands generated by an operator via a control device, and based further upon the current shift mode and throttle valve position of the engine. When the operator abruptly adjusts the throttle, the control circuit more gradually adjusts the position of the throttle valve to smooth the transition in engine speed. The control circuit also delays certain operator-commanded transitions in the engine's shift mode, as necessary, so that changes in the engine's shift mode occur while the throttle valve is in the closed or nearly closed position.

In accordance with the invention, a propulsion device and engine are interrelatedly controlled with each other to inhibit the abnormal mode change or the discomfort shock. For example, the changeover mechanism preferably is operated when an engine speed of the engine is relatively low. On the other hand, the throttle valve preferably is placed at the fully closed position or adjacent to the fully closed position when the propeller is in the neutral mode.

In accordance with one aspect of the present invention, a watercraft comprises a propulsion device. An internal combustion engine powers the propulsion device. A change device changes the propulsion device between a first mode and a second mode. The propulsion device is powered by the engine in the first mode and not powered by the engine in the second mode. A setting device sets an engine output of the engine between a minimum level and a maximum level. An operating device provides a first command that corresponds to either the first mode or the second mode and provides a second command that corresponds to the engine output. A first control device controls the change device based upon the first command. A second control device controls the setting device based upon the second command. A sensing device senses either the first mode or second mode of the propulsion device to provide a mode signal. The second control device regulates the setting device to set the engine output generally at the minimum level or to lower the engine output generally to the minimum level when the first command from the operating device and the mode signal from the sensing device differ from each other.

In accordance with another aspect of the present invention, a watercraft comprises a propulsion device. An internal combustion engine powers the propulsion device. A change device changes the propulsion device between a first mode and a second mode. The propulsion device is powered by the engine in the first mode and not powered by the engine in the second mode. A setting device sets an engine output of the engine between a minimum level and a maximum level. An operating device provides a first command that corresponds to either the first mode or the second mode and provides a second command that corresponds to the engine output. A first control device controls the change device based upon the first command. A second control device controls the setting device based upon the second command. A sensing device senses an engine speed of the engine to provide an engine speed signal. The first control device allows the change device to change the propulsion device from the second mode to the first mode based upon the engine speed signal when the engine speed is equal to or lower than a preset engine speed.

In accordance with a further aspect of the present invention, a watercraft comprises a propulsion device. An internal combustion engine powers the propulsion device. A changeover mechanism changes the propulsion device between a first mode and a second mode. The propulsion device is powered by the engine in the first mode and not powered by the engine in the second mode. An air intake device introduces air to a combustion chamber of the engine. The air intake device has a throttle valve that regulates an amount of the air. A throttle valve actuator actuates the throttle valve between a fully closed position and a fully open position. An operating device provides a first command that corresponds to either the first mode or the second mode and provides a second command that corresponds to a position of the throttle valve. A first control device controls the changeover mechanism based upon the first command. A second control device controls the throttle valve actuator based upon the second command. A sensing device senses either the first mode or second mode of the propulsion device to provide a mode signal. The second control device regulates the throttle valve actuator to place the throttle valve at an adjacent position located adjacent to the fully closed position or to move the throttle valve to the adjacent position when the first command and the mode signal differ from each other.

In accordance with a further aspect of the present invention, a control method is provided for a watercraft having a propulsion device and an engine. The method comprises operating a change device that changes the propulsion device between a first mode and a second mode based upon a first command that corresponds to either the first mode or the second mode, the propulsion device being powered by the engine in the first and not powered by the engine in the second mode, operating a setting device that sets an engine output of the engine between a minimum level and a maximum level based upon a second command that corresponds to the engine output, sensing either the first mode or the second mode of the propulsion device to provide a mode signal, determining whether the first command and the mode signal differ from each other, and setting the engine output generally at the minimum level or lowering the engine output generally to the minimum level when the first command and the mode signal differ from each other.

In accordance with a further aspect of the present invention, a control method is provided for a watercraft having a propulsion device and an engine. The method comprises operating a change device that changes the propulsion device between a first mode and a second mode based upon a first command that corresponds to either the first mode or the second mode, the propulsion device being powered by the engine in the first and not powered by the engine in the second mode, operating a setting device that sets an engine output of the engine between a minimum level and a maximum level based upon a second command that corresponds to the engine output, sensing an engine speed of the engine to provide an engine speed signal, determining whether the engine speed is equal to or lower than a preset engine speed based upon the engine speed signal, and allowing the change device to change the propulsion device from the second mode to the first mode when the determination is positive.

In accordance with a further aspect of the present invention, a control method is provided for a watercraft having a propulsion device and an engine. The method comprises operating a change device that changes the propulsion device between a first mode and a second mode based upon a first command that corresponds to either the first mode or the second mode, the propulsion device being powered by the engine in the first mode and not powered by the engine in the second mode. The method further comprises operating a throttle valve actuator that actuates a throttle valve that regulates an amount of air to a combustion chamber of the engine to move generally between a fully closed position and fully open position based upon a second command that corresponds to a position of the throttle valve, sensing either the first mode or the second mode of the propulsion device to provide a mode signal, determining whether the first command and the mode signal differ from each other, and placing the throttle valve at an adjacent position located adjacent to the fully closed position or moving the throttle valve to the adjacent position when the first command and the mode signal differ from each other.

BRIEF DESCRIPTION OF THE DRAWINGS

The foregoing and other features, aspects and advantages of the present invention are described in detail below with reference to the drawings of a preferred embodiment which is intended to illustrate and not to limit the invention. The drawings comprise 16 figures in which.

DETAILED DESCRIPTION OF THE PREFERRED EMBODIMENT OF THE INVENTION

With reference to FIGS. 1–6, a watercraft 30 configured in accordance with certain features, aspects and advantages of the present invention are described below. Although the watercraft 30 includes a communications network 32 in the illustrated embodiment, those skilled in the art will appreciate that the invention may be practiced without the use of a network.

Figure 1:
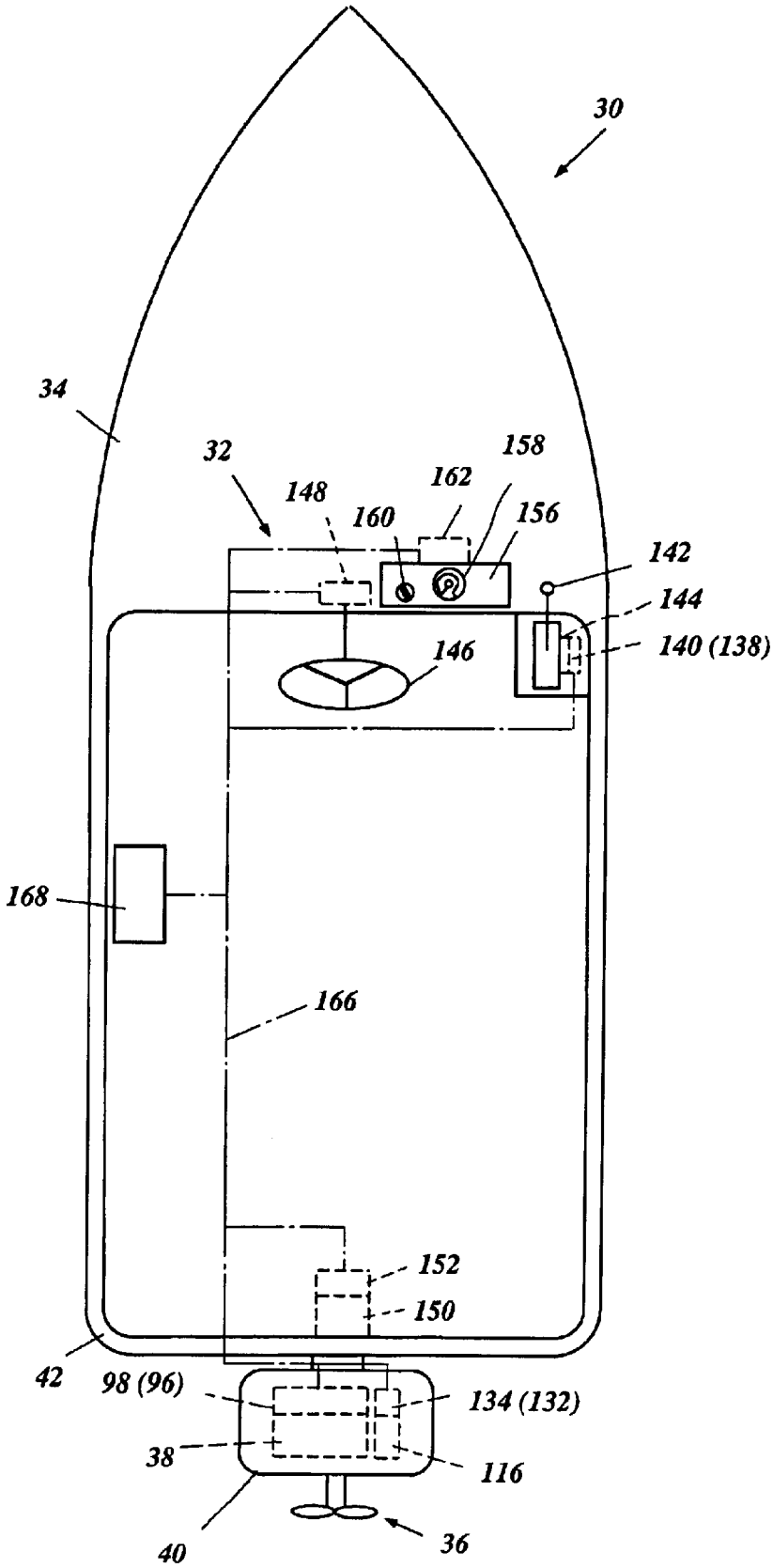
FIG. 1 illustrates a schematic representation of a top plan view of a watercraft configured in accordance with certain features, aspects and advantages of the present invention, including an outboard motor incorporating a propulsion device and an engine as part of the watercraft, wherein the propulsion device, the engine and a remote controller are electrically connected with each other through a network.

With reference to FIG. 1, the watercraft 30 has a hull 34. The watercraft 30 also has a propulsion device 36 that propels the hull 34 and an internal combustion engine 38 that powers the propulsion device 36. In the illustrated embodiment, an outboard motor 40 mounted on a transom 42 of the hull 34 incorporates the propulsion device 36 and the engine 38. Other marine drives such as, for example, stern drives can replace the outboard motor 36.

Figure 2:
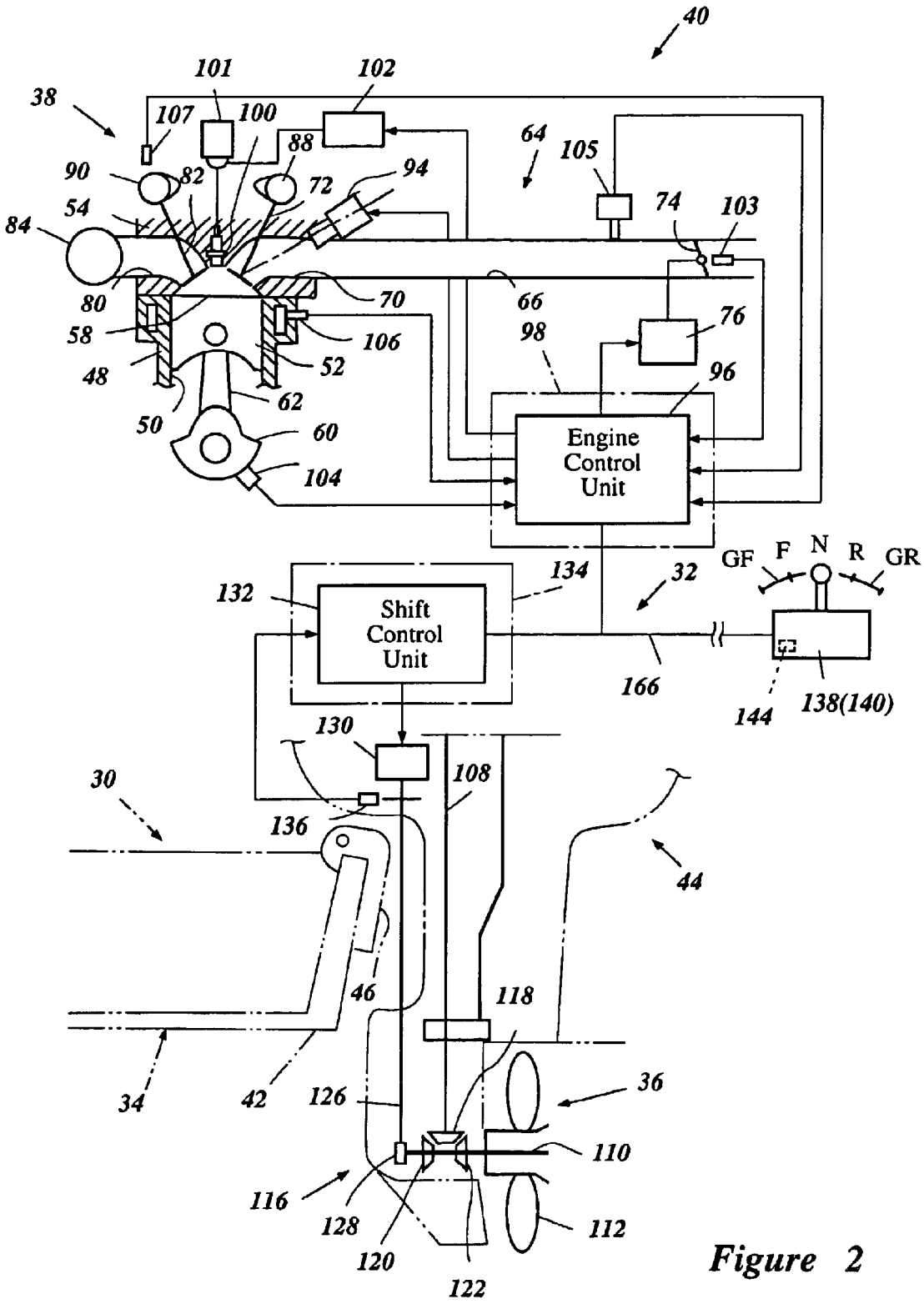
FIG. 2 illustrates a schematic representation of a side elevational view of the outboard motor of FIG. 1, showing a propeller as the propulsion device, a changeover mechanism for the propeller, the engine, the remote controller and control devices that control the propulsion device and the engine.

With reference to FIG. 2, the outboard motor 40 comprises a housing unit 44 and a bracket assembly 46. The bracket assembly 46 supports the housing unit 44 on a transom 42 of the hull 34 so as to place the propulsion device 36 in a submerged position with the watercraft 30 resting on the surface of a body of water. The bracket assembly preferably comprises a swivel bracket, a clamping bracket, a steering shaft and a tilt pin.

The engine 38 is disposed atop the housing unit 44. The engine 38 preferably operates on a four-cycle combustion principle. The engine 38 comprises a cylinder block 48 that defines four cylinder bores 50. A piston 52 can reciprocate in each cylinder bore 50. A cylinder head assembly 54 is affixed to the cylinder block 48 to close one end of the cylinder bores 50. The cylinder head assembly 54, in combination with the cylinder bores 50 and the pistons 52, define four combustion chambers 58. The cylinder head assembly 54 is disposed on the rear side of the engine 38 relative to the bracket assembly 46.

The other end of the cylinder block 48 is closed with a crankcase member that at least partially defines a crankcase chamber. A crankshaft 60 extends generally vertically through the crankcase chamber. The crankshaft 60 is connected to the pistons 52 by connecting rods 62 and is rotated by the reciprocal movement of the pistons 52.

The engine 38 preferably is provided with an air intake system 64 to introduce air to the combustion chambers 58. The air intake system 64 preferably includes a plenum chamber, air intake passages 66 and intake ports 70 that are formed in the cylinder block 48. The air intake passages 66 and the intake ports 70 are associated with the respective combustion chambers 58. The intake ports 70 are defined in the cylinder head assembly 54 and are repeatedly opened and closed by intake valves 72. When the intake ports 70 are opened, the air intake passages 66 communicate with the associated combustion chambers 58.

The engine 38 is covered with a protective cowling that has an air intake opening. Ambient air is drawn into a cavity around the engine 38 through the air intake opening. The air in the cavity is drawn into the respective air intake passages 66 through the plenum chamber. Because the intake passages 66 can communicate with the combustion chambers 58 when the intake valves 72 are opened, the air can enter the respective combustion chambers 58 at the open timing of the intake valves 72.

A throttle valve 74 preferably is disposed within each air intake passage 66 downstream of the plenum chamber to regulate an amount of air to each combustion chambers 58. The throttle valve 74 preferably is a butterfly type valve and moves between a fully closed position and a fully open position. The throttle valves 74 preferably have a common valve shaft journaled for pivotal movement. A certain amount of air is admitted to pass through the intake passage 66 in accordance with an angular position or an open degree of the throttle valve 74 when the valve shaft pivots. The angular position is a throttle valve position of the throttle valves 74 in this embodiment.

Although not shown, a bypass air passage that bypasses the throttle valve or an additional air passage preferably is provided to deliver a small amount of air to the combustion chambers when the throttle valves 74 are fully closed to maintain an idle operation of the engine. In one variation, at least one of the intake passages 66 can be approximately fully closed but not be completely closed to provide sufficient air flow for the idle operation.

A throttle valve actuator 76 preferably is coupled with the valve shaft to actuate the throttle valves 74. A servo motor preferably forms the actuator 76. Normally, the air amount or rate of airflow increases when the open degree of the throttle valves 74 increases. Also, the engine output or engine torque increases in accordance with the increase of the air amount. In other words, the engine output varies between a minimum level and a maximum level when the throttle valve position varies between the fully closed position and the fully open position. Unless the environmental circumstances change, an engine speed increases generally along the increase of the engine output. If, for example, the watercraft 30 proceeds against strong wind, the engine speed can decrease even though the engine output is constant. In addition, an intake pressure downstream of each throttle valve 74, which is a negative pressure, also increases in accordance with the increase of the airflow rate.

The engine 38 preferably is provided with an exhaust system to discharge burnt charges or exhaust gases to a location outside of the outboard motor 40 from the combustion chambers 58. Exhaust ports 80 are defined in the cylinder head assembly 54 and are repeatedly opened and closed by exhaust valves 82. An exhaust manifold 84 is connected to the exhaust ports 80 to collect the exhaust gases. The combustion chambers 58 communicate with the exhaust manifold 84 when the exhaust ports 80 are opened. The exhaust gases are discharged to a body of water that surrounds the outboard motor 40 through the exhaust manifold 84 and exhaust passages formed in the housing unit 44 when the engine 38 operates above idle. The exhaust gases also are directly discharged into the atmosphere through the exhaust manifold 84, an idle exhaust passage and an opening formed at the housing unit 44 when the engine 38 operates at idle.

An intake camshaft 88 and an exhaust camshaft 90 preferably are journaled for rotation and extend generally vertically in the cylinder head assembly 54. The intake camshaft 88 actuates the intake valves 72 while the exhaust camshaft 90 actuates the exhaust valves 82. The camshafts 88, 90 have cam lobes to push the respective valves 72, 82. Thus, the associated ports 70, 80 communicate with the combustion chambers 58 when the cam lobes push the valves 72, 82. Each camshaft 88, 90 and the crankshaft 60 preferably have a sprocket. A timing belt or chain is wound around the respective sprockets in this arrangement. Accordingly, the crankshaft 60 can drive the camshafts 88, 90 by the timing belt or chain.

The illustrated engine 38 preferably has a fuel injection system. The fuel injection system employs four fuel injectors 94 allotted for each combustion chamber 58. The fuel is reserved in a fuel tank and is pressurized by multiple fuel pumps, although FIG. 2 schematically illustrates only the fuel injector 94. Each fuel injector 94 is affixed to the cylinder head assembly 54 with a nozzle exposed into each intake port 70. The nozzle of each fuel injector 94 is directed to the associated combustion chamber 58.

The fuel injectors 94 preferably spray fuel into the intake ports 70 when the intake valves 72 are opened under control of an engine control unit 96. The sprayed fuel enters the combustion chambers 58 together with the air that passes through the intake passages 66. An amount of the sprayed fuel is determined by the engine control unit 96 in accordance with the amount of the air regulated by the throttle valves 74 to keep a proper air/fuel ratio. Typically, a fuel pressure is strictly managed by the fuel injection system. Thus, the engine control unit 96 determines a duration of the injection to determine the fuel amount. The engine control unit 96 eventually controls the duration and an injection timing of each injection.

The engine control unit 96 in this arrangement generally forms an engine control node 98 of the network system 32. The engine control node 98 will be described in greater detail below.

Other types of fuel supply system are applicable. For example, a direct fuel injection system that sprays fuel directly into the combustion chambers or a carburetor system can be applied.

The engine 38 preferably has an ignition or firing system. Each combustion chamber 58 is provided with a spark plug 100. The spark plug 100 is exposed into the associated combustion chamber 58 and ignites an air/fuel charge at a proper ignition timing. The ignition system preferably has ignition coils 101 and igniters 102 which are connected to the engine control unit 96 such that the ignition timing also is under control of the engine control unit 96.

The engine 38 and the exhaust system build much heat. Thus, the outboard motor 40 preferably has a cooling system for the engine 38 and the exhaust system. In the illustrated arrangement, the cooling system is an open-loop type water cooling system. Cooling water is introduced into the system from the body of water and is discharged there after traveling around water jackets in the engine 38 and water passages in the exhaust system. The water jackets preferably are formed in the cylinder block 48 and the cylinder head assembly 54.

As described above, the engine control unit 96 controls at least the throttle valve actuator 76, the fuel injectors 94 and the igniters 102 in the illustrated embodiment. In order to control those components 76, 94, 102, the engine control unit 96 monitors the operation of the engine using sensors.

A throttle valve position sensor 103 preferably is provided adjacent to at least one of the throttle valves 74 to sense an actual throttle valve position THd of the throttle valves 74. A sensed signal THd is sent to the engine control unit 96.

Associated with the crankshaft 60, a crankshaft angle position sensor 104 preferably is provided to sense a crankshaft angle position and outputs a crankshaft angle position signal to the engine control unit 96. The engine control unit 96 can calculate an engine speed Ne using the crankshaft angle position signal versus time. In this regard, the crankshaft angle position sensor 104 and part of the engine control unit 96 together form an engine speed sensor. The crankshaft angle position sensor 104, or another sensor, can also be used to provide reference position data to the engine control unit 96 for timing purposes, such as for the timing of fuel injection and/or ignition timing.

An intake air pressure sensor 105 preferably senses an intake pressure at least in one of the intake passages 66. The sensed signal is sent to the engine control unit 96. This signal, as well as the throttle valve position signal THd, represents an engine load. Additionally or alternatively, an air flow sensor can be disposed at least in one of the intake passages 66 to also sense the engine load.

Other sensors can be added. For example, in one embodiment, an engine temperature sensor 106 senses a temperature of the cylinder block 48 and the sensed signal is sent to the engine control unit 96. In one variation, a water temperature sensor placed at one of the water jackets of the cooling system can replace the engine temperature sensor because the water temperature varies generally in accordance with the engine temperature. A cylinder discrimination sensor 107 senses an angle position of the exhaust camshaft and the sensed signal is sent to the engine control unit 96.

The sensed signals can be transferred through hard-wired connections, emitter and detector pairs, infrared radiation, radio waves or the like. The type of signal and the type of connection can be varied between sensors or the same type can be used with all sensors.

With continued reference to FIG. 2, the housing unit 44 journals a driveshaft 108 for rotation. The driveshaft 108 extends generally vertically through the housing unit 44. The crankshaft 60 drives the driveshaft 108. The housing unit 44 also journals a propulsion shaft 110 for rotation. The propulsion shaft 110 extends generally horizontally through a lower portion of the housing unit 44. The driveshaft 108 and the propulsion shaft 110 are preferably oriented normal to each other (e.g., the rotation axis of propulsion shaft 110 is at 90° to the rotation axis of the driveshaft 108). The propulsion shaft 110 drives the propulsion device 36. In the illustrated arrangement, the propulsion device 36 is a propeller 112 that is affixed to an outer end of the propulsion shaft 110. The propulsion device 36, however, can take the form of a dual, a counter-rotating system, a hydrodynamic jet, or any of a number of other suitable propulsion devices.

The changeover mechanism or transmission 116 preferably is provided between the driveshaft 108 and the propulsion shaft 110. The changeover mechanism 116 in this arrangement comprises a drive pinion 118, a forward bevel gear 120 and a reverse bevel gear 122 to couple the two shafts 108, 110. The drive pinion 118 is disposed at the bottom of the driveshaft 108. The forward and reverse bevel gears 120, 122 are disposed on the propulsion shaft 110 and spaced apart from each other. Both bevel gears 120, 122 always mesh with the drive pinion 118. The bevel gears 120, 122, however, race on the propulsion shaft 110 unless fixedly coupled with the propulsion shaft 110.

A dog clutch unit (not shown), which also is a member of the changeover mechanism 116, is slidably but not rotatably disposed between the bevel gears 120, 122 on the propulsion shaft 110 so as to selectively engage the forward bevel gear 120 or the reverse bevel gear 122 or not engage any one of the forward and reverse bevel gears 120, 122. The forward bevel gear 120 or the reverse bevel gear 122 can be fixedly coupled with the propulsion shaft 110 when the dog clutch unit engages the forward bevel gear 120 or the reverse bevel gear 122, respectively.

The changeover mechanism 116 further has a shift rod 126 that preferably extends vertically through the steering shaft of the bracket assembly 46. The shift rod 126 can pivot about an axis of the shift rod 126. The shift rod 126 has a shift cam 128 at the bottom. The shift cam 128 abuts a front end of the dog clutch unit. The dog clutch unit thus follows the pivotal movement of the cam 128 and slides on the propulsion shaft 110 to engage either the forward or reverse bevel gear 120, 122 or not engage any one of the bevel gears 120, 122.

Engagement states of the forward and reverse bevel gear 120, 122 with the dog clutch unit correspond to operational modes of the propeller 112. The operational modes of the propeller 112 include a forward mode F, a reverse mode R and a neutral mode N. The first engagement state in which the dog clutch unit engages the forward bevel gear 120 corresponds to the forward mode F. The second engagement state in which the dog clutch unit engages the reverse bevel gear 122 corresponds to the reverse mode R. The third engagement state in which the dog clutch unit does not engage the forward bevel gear 120 or the reverse bevel gear 122 corresponds to the neutral mode N. In the forward mode F, the propeller 112 rotates in a right rotational direction that propels the watercraft 30 forwardly. In the reverse mode R, the propeller 112 rotates in a reverse rotational direction that propels the watercraft 30 backwardly. In the neutral mode N, the propeller 112 does not rotate and does not propel the watercraft 37. In this description, the operational mode of the propeller 112 is called the "shift mode." Also, the engagement state of the dog clutch unit is called the "shift position."

In the illustrated embodiment, a shift rod actuator 130, which preferably is a servo motor, is coupled with the top end of the shift rod 126 to pivot the shift rod 126. The shift rod actuator 130 is under control of a shift control unit 132. The shift control unit 132 in this arrangement generally forms a shift control node 134 of the network system 32 and will be described in greater detail below. The shift control unit 132 commands the shift rod actuator 130 to actuate the shift rod 126. The shift cam 128 thus brings the dog clutch unit into the first, second or third engagement state (i.e., forward shift position F, reverse shift position R or neutral shift position N).

As described above, the shift control unit 132 controls at least the shift rod actuator 130 in the illustrated embodiment. In order to control the shift rod 130, the shift control unit 132 monitors at least an actual angular position of the shift rod 126. The outboard motor 40 thus has a shift rod angle position sensor 136 adjacent to the shift rod 126. Rotary potentiometers or encoders such as, for example, an optical encoder or a magnetic encoder can form the shift rod angle position sensor 136. The sensed signal is sent to the shift control unit 132.

The operator can input a certain throttle valve position command THr to the engine control unit 96 and a shift position command Sr to the shift control unit 132 through an operating device. The operating device in this embodiment is a remote controller 138 that preferably is disposed at a cockpit of the watercraft 30. The remote controller 138 forms a remote controller node 140 of the network system 32. The remote controller node 140 will be described in greater detail below.

The remote controller 138 preferably has a control lever 142 that is journaled on a housing of the remote controller 138 for pivotal movement. The control lever 142 is operable by the operator so as to pivot between two limit ends. A reverse acceleration range GR, a reverse troll position R, a neutral position N, a forward troll position F and a forward acceleration range GF can be selected in this order between the limit ends. That is, one limit end corresponds to a most accelerated position of the reverse acceleration range GR and the other limit end corresponds to a most accelerated position of the forward acceleration range GF. The reverse troll position R is consistent with a least accelerated position of the reverse acceleration range GR, while the forward troll position F is consistent with a least accelerated position of the forward acceleration range GF. Preferably, the control lever 142 stays at any position between the limit ends unless the operator operates the lever 142.

A control lever angle position sensor 144 is disposed adjacent to the control lever 142 to sense an angle position è of the control lever 142. The sensed signal is transferred to the engine control unit 96 and the shift control unit 32 through the network system 32. Rotary potentiometers or encoders such as, for example, an optical encoder or a magnetic encoder can form the control lever angle position sensor 144.

The remote controller 138 preferably provides the engine control unit 96 and the shift control unit 132 with the throttle valve position command THr and a shift position command Sr, respectively, in accordance with an angle position or rotational angle degree è of the control lever 142 through the network system 32.

More specifically, the position è of the control lever 142 within the reverse acceleration range GR designates the reverse shift position (reverse mode) R and a throttle valve position between the fully closed position and the fully open position. In this state, the propeller 112 rotates in the reverse direction and in an accelerated speed corresponding to the engine speed.

The position è of the control lever 142 at the reverse position R designates the reverse shift position (reverse mode) R and a throttle valve position at the fully closed position. In this state, the propeller rotates in the reverse direction and in a troll speed. The troll speed preferably is a speed corresponding to the idle engine speed. The reverse troll position R substantially is equal to the least accelerated position of the reverse acceleration range GR. Additionally, the reverse troll position R preferably provides a reference level of an actual shift position Sd.

The position è of the control lever 142 at the forward position F designates the forward shift position (forward mode) F and a throttle valve position at the fully closed position. In this state, the propeller 112 rotates in the forward direction and in the troll speed The position è of the control lever 142 within the forward acceleration range GF designates the forward shift position (forward mode) F and a throttle valve position between the fully closed position and the fully open position. In this state, the propeller 112 rotates in the forward direction and in an accelerated speed corresponding to the engine speed. The forward troll position F substantially is equal to the least accelerated position of the forward acceleration range GF.

In one alternative, the remote controller 54 can have two control levers each separately provides the throttle valve position command THr and the shift position command Sr to the engine control unit 96 and the shift control unit 132, respectively. In another alternative, stick or sticks which slidably move can replace the control lever or levers, respectively.

With reference back to FIG. 1, the outboard motor 40 preferably is steerable relative to the transom 42 of the hull 34. A steering actuator such as, for example, a servomotor is provided at the outboard motor 40. The housing unit 44 pivots about a steering axis that extends through the steering shaft of the bracket assembly 46.

A steering unit 146 preferably is placed at a center of the cockpit. The illustrated steering unit 146 incorporates a steering wheel mounted on the hull 34 for pivotal movement and a steering position sensor (not shown) to sense an angle position of the steering wheel. The operator can operate the steering wheel to provide a steering position of the outboard motor 40. The steering unit 146 has a steering node 148 of the network system 32.

In one variation, the steering wheel can be mechanically coupled with the outboard motor 40 through a mechanical cable. Additionally, the outboard motor 40 can be tilted about a tilt axis that extends generally horizontally through the tilt pin of the bracket assembly 46.

The remote controller 138 preferably is provided on the right-hand side of the cockpit. Preferably, the remote controller 138 and the steering wheel of the steering unit 146 are disposed next to each other such that the operator can operate them simultaneously.

With continued reference to FIG. 1, a watercraft velocity sensor 150 preferably is mounted on an outer bottom of the hull 34 in the stern of the watercraft 30. The velocity sensor 150 preferably incorporates a Pitot tube and senses a water pressure in the tube to detect a velocity of the watercraft 30. The velocity sensor 150 has a velocity sensor node 152 of the network system 32.

A display unit 156 preferably extends between the remote controller 54 and the steering unit 146 on the hull 34. The illustrated display unit 156 includes at least a speedometer 158 to indicate an engine speed Ne of the engine 38. The display unit 156 can include other meters or panels that indicate, for example, the watercraft velocity, the shift position, a direction of travel and other information that is used to operate the watercraft 30.

A switch key recess 160 preferably is formed at a top surface of the display unit 156 next to the speedometer 158. The switch key recess 160 receives a switch key to operate a main switch unit that activates electrical components including the network system 32. Preferably, the main switch unit is unitarily assembled with the display unit 156. That is, the electrical components are connected to an electric source such as, for example, one or more batteries when the operator inserts the switch key into the switch key recess 160 and rotates the switch key to turn the main switch unit on. The display unit 156 has a display node 162 of the network system 32.

The network system 32 in the illustrated embodiment is a controller area network (CAN) that is one type of a local area network (LAN). A bus or bus line 166 of the network system 32 connects the engine control node 98, the shift control node 134, the remote controller node 140, the steering node 148, the velocity sensor node 152 and the display node 162, all of which are terminal nodes of the network system 32. A network management node 168 also is connected to the bus 166 to manage the terminal nodes 98, 134, 140, 148, 152, 162.

The illustrated bus 166 preferably is formed with twisted pair cables. Each terminal node 98, 134, 140, 148, 152, 162 has a classification identifier or ID that specifies its type. Each terminal node 98, 134, 140, 148, 152, 162 creates a transferring frame or packet that has an ID field in which the classification identifier can be included and a data field in which a product or parts number, a manufacturing number, a manufacturer number and other specific data can be included. Each terminal node 98, 134, 140, 148, 152, 162 transfers its frames on the bus 166 according to certain timing to communicate with other terminal nodes and/or the management node 168. The management node 168 manages communication among these terminal nodes 98, 134, 140, 148, 152, 162. For communication purposes, the management node 168 assigns a network address to each terminal node 98, 134, 140, 148, 152, 162. A medium access method such as, for example, a carrier sense multiple access/collision detection (CSMA/CD) method preferably is used to access the bus 166.

The bus 166 can be connect to the nodes 98, 134, 140, 148, 152, 162, 168 in any form such as, for example, a ring form and a star form. The bus 166 can use any cables or wires other than the twisted pair cables such as, for example, Ethernet (CAT-5) or optical cables. Furthermore, a wireless type bus that has no cables or wires can replace the illustrated bus 166.

Such a network system is disclosed in, for example, a co-pending U.S. application filed July **, 2003, titled MULTIPLE NODE NETWORK AND COMMUNICATION METHOD WITHIN THE NETWORK, the entire contents of which are hereby expressly incorporated by reference.

Because of the structure of the network 32, the engine control unit 96 and the shift control unit 132 can monitor and use all of the data that is transmitted on the network system 32 including the watercraft velocity data. For instance, the engine control unit 96 can monitor to the shift rod angle position (or shift position) Sd that is primarily sent to the shift control unit 132. On the other hand, the shift control unit 132 can monitor to the throttle valve position THd that is primarily sent to the engine control unit 96. More generally, any node can monitor the transmissions of any other node.

Figure 3:
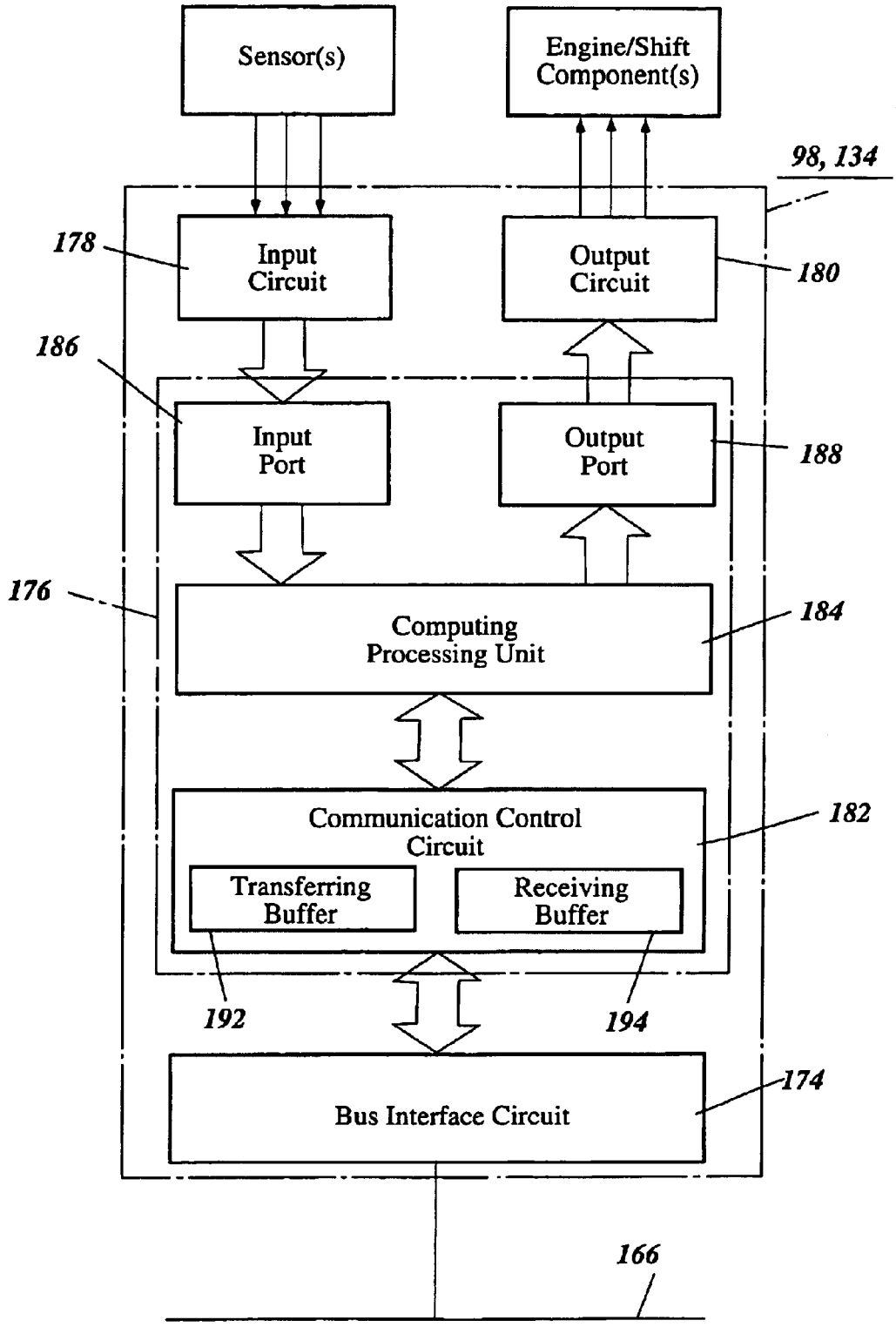
FIG. 3 illustrates a block diagram of a control node or unit that may be either an engine control node (or unit) associated with the engine or a shift control node (or unit) associated with the changeover mechanism and the propeller, wherein the engine control node and the shift control node are part of the network of FIG. 1 and work as the control devices of FIG. 2.

With reference to FIG. 3, the engine control node 98 and the shift control node 134 have the same structure, and are thus represent by a common block diagram. Each comprises a bus interface circuit 174, a microcomputer 176, an input circuit 178 and an output circuit 180. The microcomputer 176 is a central processor of the engine control node 98 or the shift control node 134 and includes a communication control circuit 182, a computing processing unit 184, an input port 186 and an output port 188.

The microcomputer 176 of the engine control node 98 is preferably connected to at least the throttle valve position sensor 103, the crankshaft angle position sensor 104, the intake pressure sensor 105, the engine temperature sensor 106 and the cylinder discrimination sensor 107 through the input circuit 178. The microcomputer 176 of the shift control node 134 is preferably connected to at least the shift rod angle position sensor 136 through the input circuit 178. The input circuit 178 of the engine control node 98 receives sensed signals or data from those sensors 103, 104, 105, 106, 107 and sends the data to the input port 186. The input circuit 178 of the shift control node 134 receives sensed signals or data from the sensor 136 and sends the data to the input port 186.

The input port 186 of the engine control node 98 receives the actual throttle valve position data and the crankshaft angle position data from the input circuit 178 and passes those data over to the engine control nodes computing processing unit 184. The input port 186 of the shift control node 134 receives the actual shift rod angle position data and passes the data over to the shift control node's computing processing unit 184.

The microcomputer 176 of the engine control node 98 is connected to the throttle valve actuator 76, the fuel injectors 94 and the igniters 102 through the output circuit 180. The microcomputer 176 of the shift control node 134 is connected to the shift rod actuator 30 through the output circuit 180. The output port 188 receives control data from the computing processing unit 184 and passes the data over to the output circuit 180. The output circuit 180 then transfers the control data to the actuator(s).

The computing processing unit 184 communicates with the communication control circuit 182 that has a transferring buffer 192 and a receiving buffer 194. The communication control circuit 182 is connected to the bus 166 through the bus interface circuit 174.

The computing processing unit 184 includes at least one non-volatile storage component or memory such as, for example, a ROM or EPROM device. The non-volatile storage preferably stores the classification identifier or ID, the product or part number, the manufacturing number, the manufacturer number and the specific data, as well as executable code. The computing processing unit 184 also includes one or more volatile storage components such as, for example, RAM to store a network address that will be assigned from the management node 168.

The non-volatile storage of the engine control node 98 also stores control maps. The computing processing unit 184 of the engine control node 98 calculates the engine speed Ne based upon the signal from the crankshaft angle position sensor 104. The computing processing unit 184 of the engine control node 98 also calculates a throttle valve position control value THc, the injection timing and duration of the fuel injectors 94 and the ignition timing of the igniters 102 based upon the following: the engine speed Ne, the throttle valve position THd from the throttle valve position sensor 103, the throttle valve position command THr from the remote controller node 140, the shift position command Sr from the remote controller node 140 and a shift position domain Sa from the shift control node 134. The engine control node 98 controls the throttle valve actuator 76, the fuel injectors 94 and the igniters 102 in accordance with the calculated results.

In addition, the computing processing unit 184 of the engine control node 98 creates transferring frames one by one, each including the classification identifier in the ID field and the throttle valve position THd and the engine speed Ne in the data field.

The computing processing unit 184 of the shift control node 134 controls the shift rod actuator 130 based upon the shift position Sd and a shift position domain Sa; the engine speed Ne and the throttle valve position THd from the engine control node 98; and the throttle valve position command THr and the shift position command Sr from the remote controller node 140. The shift position domain Sa is determined based upon the shift position Sd sensed by the shift rod angle position sensor 136.

In addition, the computing processing unit 184 of the shift control node 134 creates transferring frames one by one, each including the Classification identifier in the ID field and the shift position domain Sa in the data field.

The engine control node 98 and the shift control node 134 output the transferring frames to the bus 166 through their respective communication control circuits 182 and bus interface circuits 174.

Additionally, the computing processing unit 184 of the engine control node 98 and the shift control node 134 have a timeout counter that increments count numbers.

The engine control unit 96 is substantially identical in structure to the engine control node 98 except for the bus interface circuit 174. Also, the shift control unit 132 is substantially identical in structure to the shift control node 134 except for the bus interface circuit 174.

Figure 4:
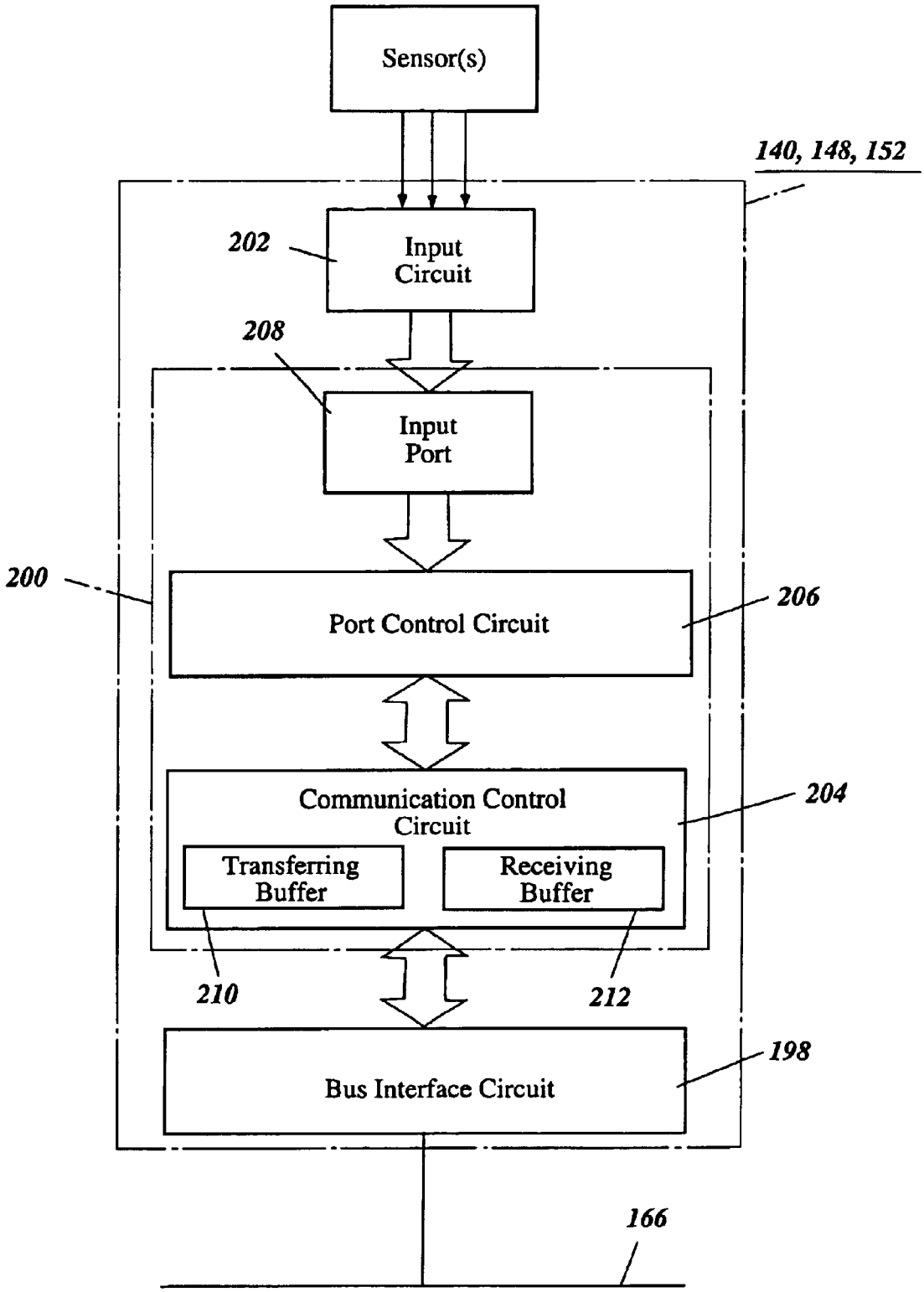
FIG. 4 illustrates a block diagram of a node that may be either a velocity sensor node, a remote controller node associated with the remote controller of FIG. 2, or a steering angle sensor node, all of which may be part of the network of FIG. 1.

With reference to FIG. 4, the remote controller node 140, the steering node 148 and the velocity sensor node 152 each comprise a bus interface circuit 198, a microcomputer 200 and an input circuit 202. The microcomputer 200 is a central processor of those nodes 140, 148, 152 and includes a communication control circuit 204, a port control circuit 206 and an input port 208.

The microcomputer 200 of the remote controller node 140 is connected to the control lever angle position sensor 144 and receives the angle position è of the control lever 142 through the input circuit 202. The microcomputer 200 of the steering node 148 is connected to the steering position sensor and receives the steering position signal from the steering position sensor through the input circuit 202. The microcomputer 200 of the watercraft velocity node 152 is connected to the velocity sensor 152 and receives the watercraft velocity signal from the velocity sensor 152 through the input circuit 202. The received data are sent to the input port 208, which passes the data over to the port control circuit 206. The port control unit 206 communicates with the communication control circuit 204 that has a transferring buffer 210 and a receiving buffer 212. The communication control circuit 204 is connected to the bus 166 through the bus interface circuit 110.

The port control circuit 206 incorporates at least one non-volatile storage or memory component such as, for example, a ROM or EPROM device. The non-volatile storage preferably stores at least executable code, a classification identifier or ID allotted to the remote controller node 140, the steering node 148 or the velocity sensor node 152. The port control circuit 206 of the remote controller node 140 creates transferring frames one by one, each including at least the classification identifier in the ID field and the throttle valve position command THr and the shift position command Sr in the data field. The port control circuit 206 of the steering node 148 creates transferring frames one by one, each including at least the classification identifier in the ID field and the steering position data in the data field. The port control circuit 206 of the velocity sensor node 152 creates transferring frames one by one, each including at least the classification identifier in the ID field and the watercraft velocity data in the data field.

The port control circuit 206 also incorporates one or more pieces of volatile storage such as, for example, RAM to store the network address that will be assigned from the management node 168.

Figure 5:
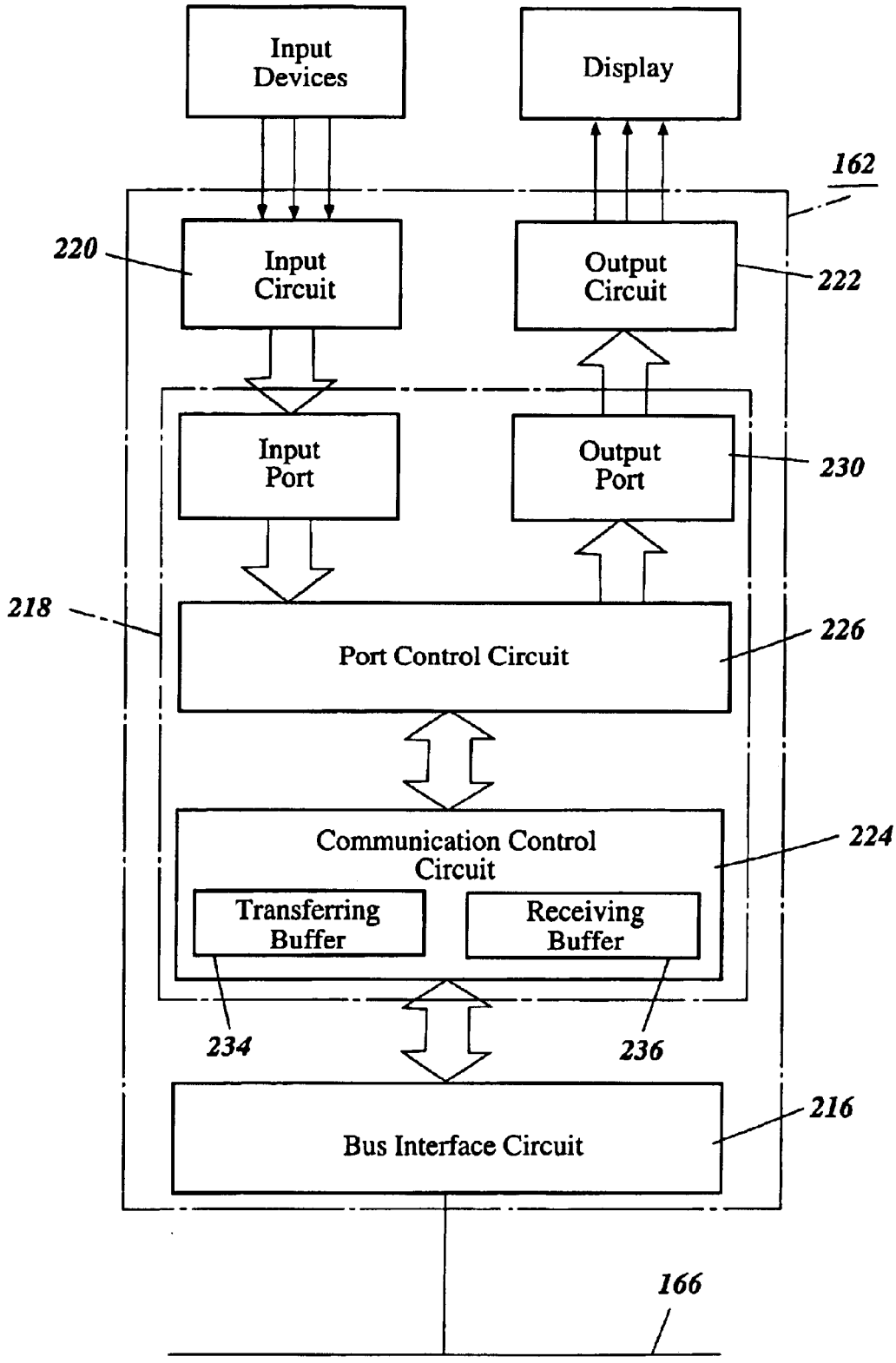
FIG. 5 illustrates a block diagram of a display unit which is part of the network of FIG. 1.

With reference to FIG. 5, the display node 162 comprises a bus interface circuit 216, a microcomputer 218, an input circuit 220 and an output circuit 222. The microcomputer 218 is a central processor of the display node 162 and includes a communication control circuit 224, a port control circuit 226, an input port 228 and an output port 230.

The microcomputer 218 is connected through the input circuit 220 to the main switch unit and various devices that have data those can be displayed on the display unit 156. For instance, the devices can include a compass or a residual fuel amount sensor, if any. The watercraft velocity sensor 46, for example, can be excluded because the watercraft velocity data is transferred to the display node 162 through the bus 166. The input circuit 220 receives the main switch signal and the display data and sends the signal and data to the input port 228. The input port 228 receives the signal and data from the input circuit 220 and passes them to the port control circuit 226.

The microcomputer 218 also is connected to respective meters or panels of the display unit 156 through the output circuit 222. The output port 230 receives the display data from the port control circuit 226 and passes the data over to the output circuit 222. The output circuit 222 then transfers the display data to the meters or panels of the display unit 156.

The port control circuit 226 communicates with the communication control circuit 224. The communication control circuit 224 has a transferring buffer 234 and a receiving buffer 236 and is connected to the bus 166 through the bus interface circuit 216.

The port control circuit 226 incorporates at least one non-volatile storage or memory component such as, for example, a ROM or EPROM device. The non-volatile storage preferably stores at least a classification identifier or ID allotted to the display node 162. The port control circuit 226 creates at least one transferring frame including at least the classification identifier in the ID field. The port control circuit 226 also incorporates one or more pieces of volatile storage such as, for example, RAM to store a network address that will be assigned from the management node 168.

Figure 6:
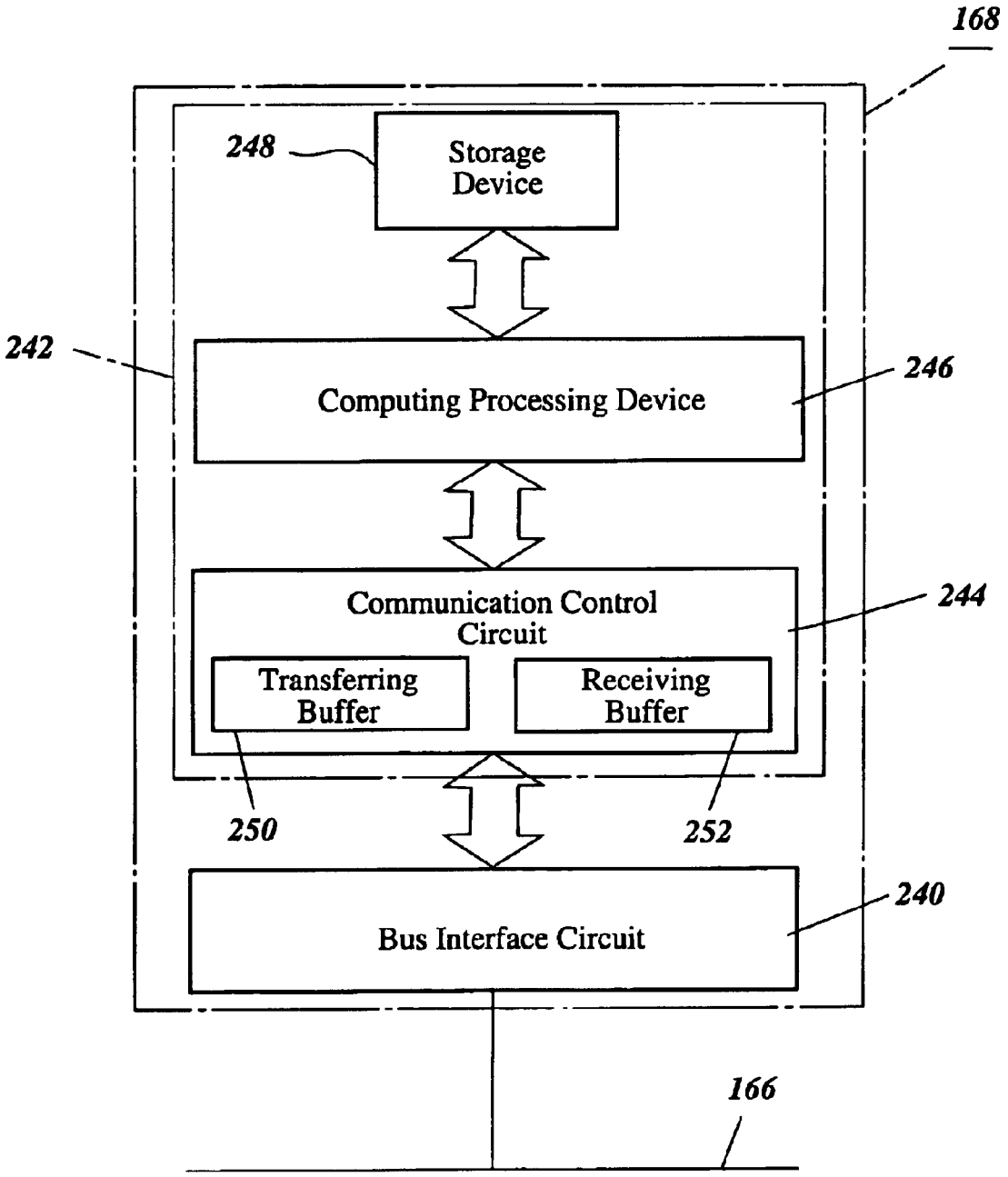
FIG. 6 illustrates a block diagram of a network management node which is part of the network of FIG. 1.

With reference to FIG. 6, the network management node 168 comprises a bus interface circuit 240 and a microcomputer 242. The microcomputer 242 is a central processor of the management node 168 and includes a communication control circuit 244, a computing processing device 246 and a storage device 248.

The computing processing device 246 communicates with the communication control circuit 244. The communication control circuit 244 has a transferring buffer 250 and a receiving buffer 252 and is connected to the bus 166 through the bus interface circuit 240.

The computing processing device 246 also communicates with the storage device 248. The storage device 248 has at least one volatile storage component or memory such as, for example, RAM. The storage device 248 can also have non-volatile storage. The storage device 248 preferably stores a classification list indicating relationships between classifications and the classification identifiers, and a network address list indicating relationships between network addresses that will be assigned to the respective terminal nodes 98, 134, 140, 148, 152, 162, and the classification identifiers and the manufacturing numbers of those terminal nodes 98, 134, 140, 148, 152, 162.

Figure 7:
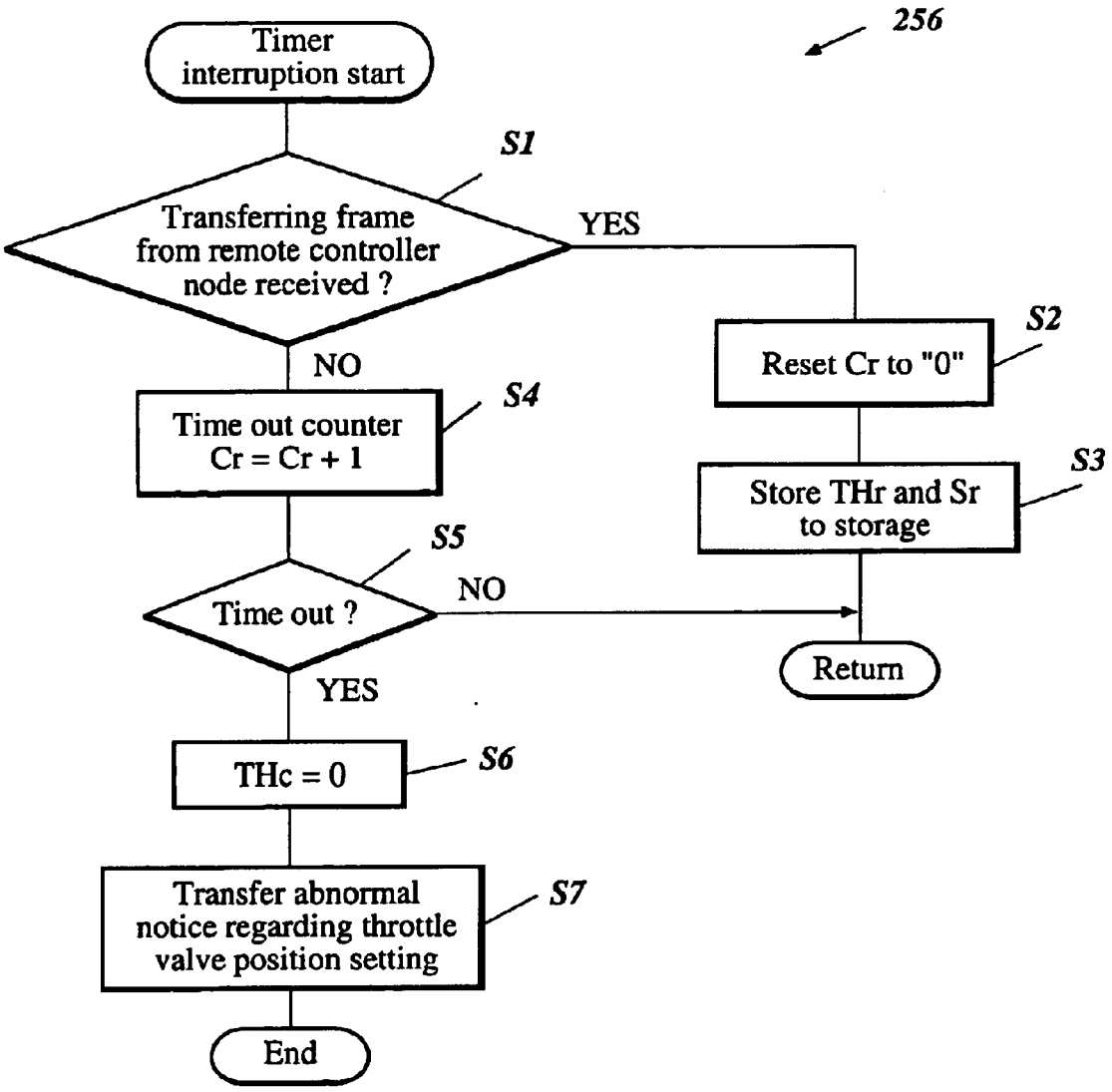
FIG. 7 illustrates a flow chart of an embodiment of a timer interruption program for a command reading process of the engine control node that is executed after receiving a transfer frame from the remote controller node.
Figure 8:
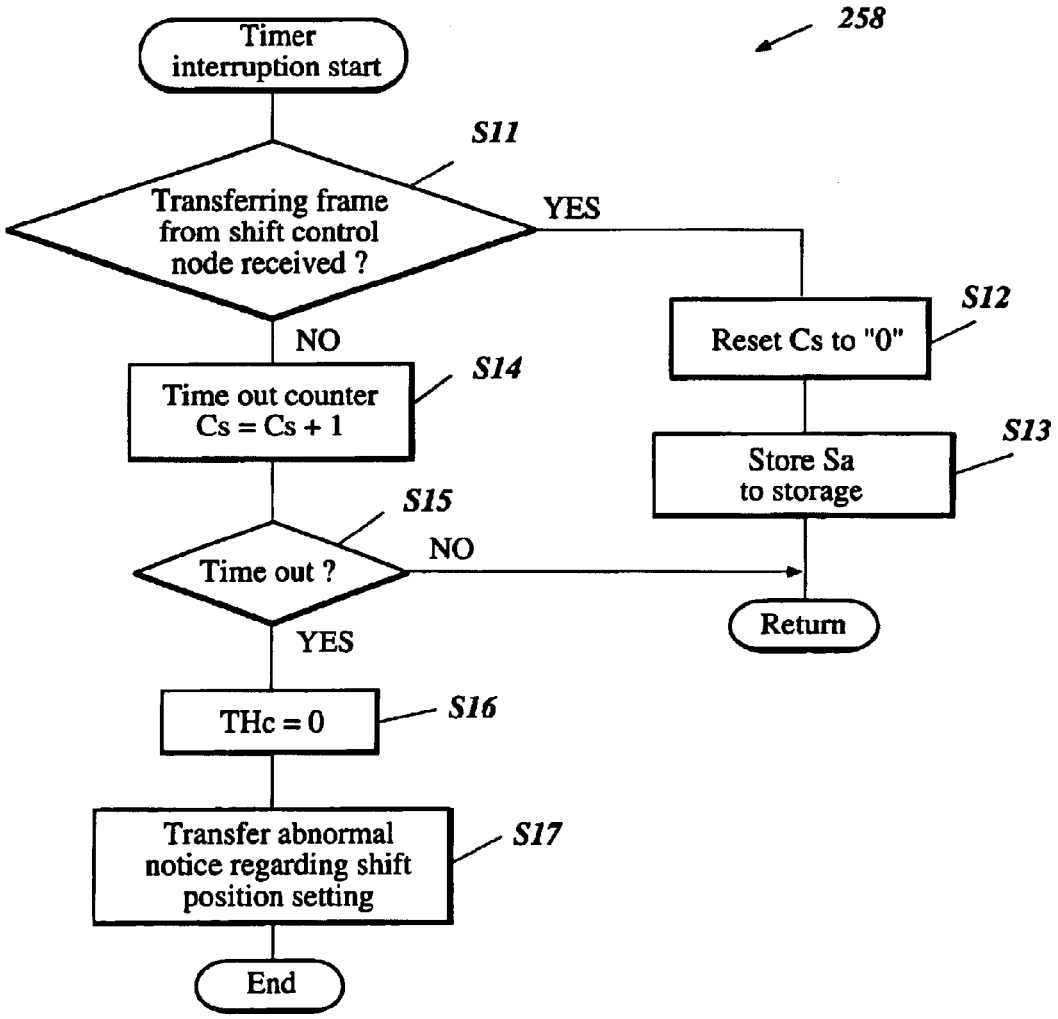
FIG. 8 illustrates a flow chart of an embodiment of a timer interruption program for a shift position reading process of the engine control node that is executed after receiving a transfer frame from the shift control node.
Figure 9:
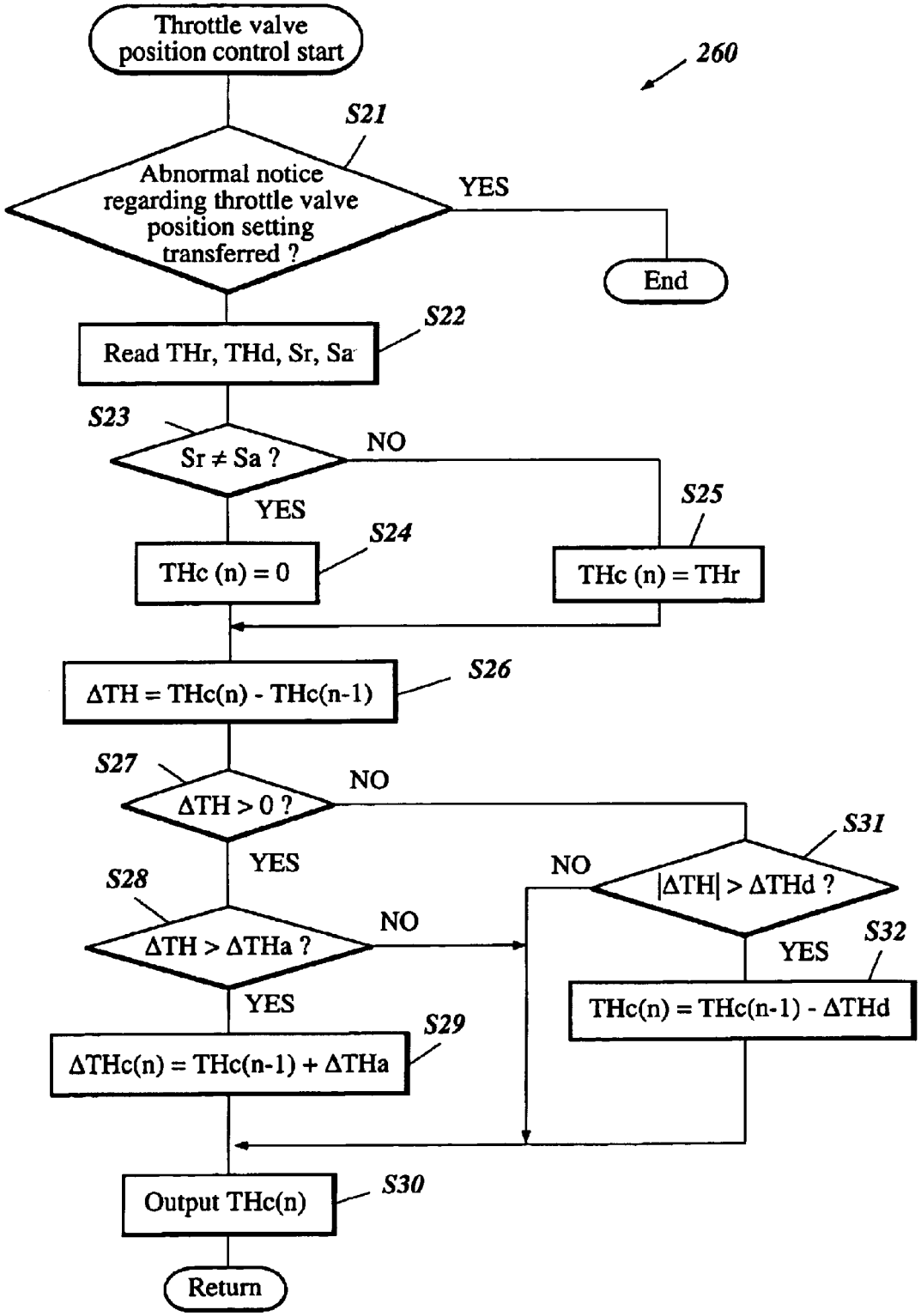
FIG. 9 illustrates a flow chart of an embodiment of a timer interruption program for a throttle valve position setting a process of the engine control node to set a throttle valve position.

With reference to FIGS. 7–9, the microcomputer 176 of the engine control node 98 conducts a command reading process (FIG. 7) to read the throttle valve position command THr and the shift position command Sr transferred from the remote controller node 140; a shift position domain reading process (FIG. 8) to read the shift position domain Sa transferred from the shift control node 134; and a throttle valve position setting process (FIG. 9). These processes may be implemented within software executed by the engine control node 98.

With reference to FIG. 7, the command reading process of the engine control node 98 preferably is conducted by timer interruption program 256. The engine control node 98 interrupts a primary control program, which is already running, every preset time period (e.g., 10 msec) to execute the timer interruption program 256.

The engine control node 98, at a step S1, determines whether a transferring frame that has the data field including a throttle valve position command THr and a shift position command Sr has been received from the remote controller node 140. If the determination is positive, the program 256 goes to a step S2.

At the step S2, the engine control node 98 resets a count value Cr of the timeout counter to "0." The program 256 then goes to a step S3.

The engine control node 98, at the step S3, extracts and stores the throttle valve position command THr and the shift position command Sr from the data field of the transferring frame. The program 256 then returns control to the primary control program.

If the determination at the step S1 is negative, i.e., the transferring frame has not been received yet from the remote controller node 140, the program goes to a step S4. The engine control node 98, at the step S4, increments the counter value Cr of the timeout counter by "1." Then, the program 256 goes to a step S5.

At the step S5, the engine control node 98 determines whether the count value Cr of the timeout counter has reached a preset number indicative of a timeout event. If the determination is negative, the program 256 temporarily ends and returns control to the primary control program.

If the determination at the step S5 is positive, the engine control node 98 recognizes that a necessary transferring frame was not obtained from the remote controller node 140 within the preset time and the program 256 goes to a step S6. The engine control node 98, at the step S6, sets the throttle valve position control value THc to "0" (i.e., fully closed position). The program 256 then goes to a step S7. At the step S7, the engine control node 98 creates a transferring frame that has an abnormal notice regarding the throttle valve position setting in the data filed and transfers the frame to the bus 166. The program 256 ends afterwards. The engine control node 98 can warn the operator when the abnormal condition occurs by the display unit 156 or by a buzzer using the primary control program or another program that may include a step for the warning.

With reference to FIG. 8, the shift position reading process preferably is conducted along a timer interruption program 258. The engine control node 98 interrupts the primary control program every preset time period (e.g., 10 msec) to conduct the timer interruption program 258.

The engine control node 98, at a step S11, determines whether a transferring frame that has the data field including an actual shift position domain Sa has been received from the shift control node 134. If the determination is positive, the program 258 goes to a step S12.

At the step S12, the engine control node 98 resets a count value Cs of the timeout counter to "0." The program 258 then goes to a step S13.

The engine control node 98, at the step S13, extracts and stores the shift position domain Sa from the data field of the transferring frame. The program 258 temporarily ends and returns control to the primary control program.

If the determination at the step S11 is negative, i.e., the transferring frame has not been received yet from the shift control node 134, the program 258 goes to a step S14 at which the engine control node 98 increments the counter value Cs of the timeout counter by "1." Then, the program 258 goes to a step S15.

At the step S15, the engine control node 98 determines whether the count value Cs of the timeout counter has reached a preset timeout number. If the determination is negative, the engine control node 98 the program 258 temporarily ends and returns control to the primary control program.

If the determination at the step S15 is positive, the engine control node 98 recognizes that a necessary transferring frame was not obtained from the shift control node 134 within the preset time and the program 258 goes to a step S16. The engine control node 98, at the step S16, sets the throttle valve position control value THc to "0" (i.e., fully closed position). The program 258 then goes to a step S17 at which the engine control node 98 transmits a frame that has an abnormal notice regarding the throttle valve position setting in the data filed. The program 258 ends afterwards. Under this condition, the engine control node 98 can also warn the operator of the abnormal condition by the display unit 156 or by a buzzer using the primary control program or another program that may include a step for the warning.

With reference to FIG. 9, the throttle valve position setting process preferably is conducted by a timer interruption program 260. The engine control node 98 interrupts the primary control program every preset time period (e.g., 10 msec) to conduct the timer interruption program 260.

At step S21, the engine control node 98 determines whether the abnormal notice regarding the throttle valve position setting has been transferred. If the determination is positive, the program 260 ends. If the determination is negative, the program 260 goes to a step S22.

At the step S22, the engine control node 98 reads the throttle valve position command THr, the shift position command Sr and the actual shift position domain Sa that are stored in the storage of the computing processing unit 184 and an actual throttle valve position THd from the throttle valve position sensor 103. The program 260 then goes to a step S23 and determines whether the shift position domain Sa is inconsistent with the shift position command Sr. If the determination is positive, the engine control node 98 recognizes that the control lever 142 is under a transitional condition from one position to another position and the program 260 goes to a step S24.

At the step S24, the engine control node 98 sets the throttle valve position control value THc to "0" (i.e., fully closed position). The engine control node 98 also renews the stored throttle valve position control value to "0." The reference mark "THc(n)" of the step S24 indicates a current throttle valve position control value. The program 260 then goes to a step S26.

If the determination at the step S23 is negative, the engine control node 98 recognizes that the control lever 142 is already set at one of the shift positions F, R, N and the program 260 goes to a step S25. The engine control node 98, at the step S25, sets the throttle valve position control value THc to the throttle valve control command THr. The engine control node 98 also renews the stored throttle valve position control value to THr. The reference mark "THc(n−1)" indicates the immediately previous throttle valve position control value. The program 260 then goes to a step S26.

At the step S26, the engine control node 98 calculates a difference ÄTH between the current throttle valve position control value THc(n) and the immediately previous throttle valve position control value THc(n−1) using an equation as follows:

$$ÄTH=THc(n)-THc(n-1)$$

The program 260 then goes to a step S27 and determines whether the difference ÄTH is greater than "0." If the determination is positive, the engine control node 98 recognizes that the difference ÄTH indicates increase tendency and the program 260 goes to a step S28.

At the step S28, the engine control node 98 determines whether the difference ÄTH is greater than a preset increase threshold value ÄTHa. If the determination is positive, the program 260 goes to a step S29 and calculates a throttle valve control value THc(n) using an equation as follows:

$$THc(n)=THc(n-1)+ÄTHa$$

The engine control node 98 also renews the stored throttle valve position control value to the calculated THc(n). The program 260 then goes to a step S30, at which the engine control node 98 provides the calculated throttle valve position control value THc(n) to the throttle valve control actuator 76 and ends the interruption. The program 260 temporarily ends and returns control to the primary control program.

If the determination at the step S28 is negative, the program 260 goes to the step S30 and outputs THc(n)=0.

If the determination at the step S27 is negative, i.e., the difference ÄTH is equal to or less than "0," the engine control node 98 recognizes that the difference ÄTH indicates decrease tendency and the program 260 goes to a step S31. The engine control node 98, at the step S31, determines whether the absolute value of the difference ÄTH is greater than a preset decrease threshold value ÄTHd. If the determination at the step S31 is negative, the program 260 goes to the step S30. If the determination at the step S31 is positive, the program 260 goes to a step S32 and calculates a throttle valve control value THc(n) using an equation as follows:

$$THc(n)=THc(n-1)-ÄTHd$$

The engine control node 98 also renews the stored throttle valve position control value to the calculated THc(n). The program 260 then goes to the step S30 and outputs THc(n) as calculated in step S32.

Figure 10:
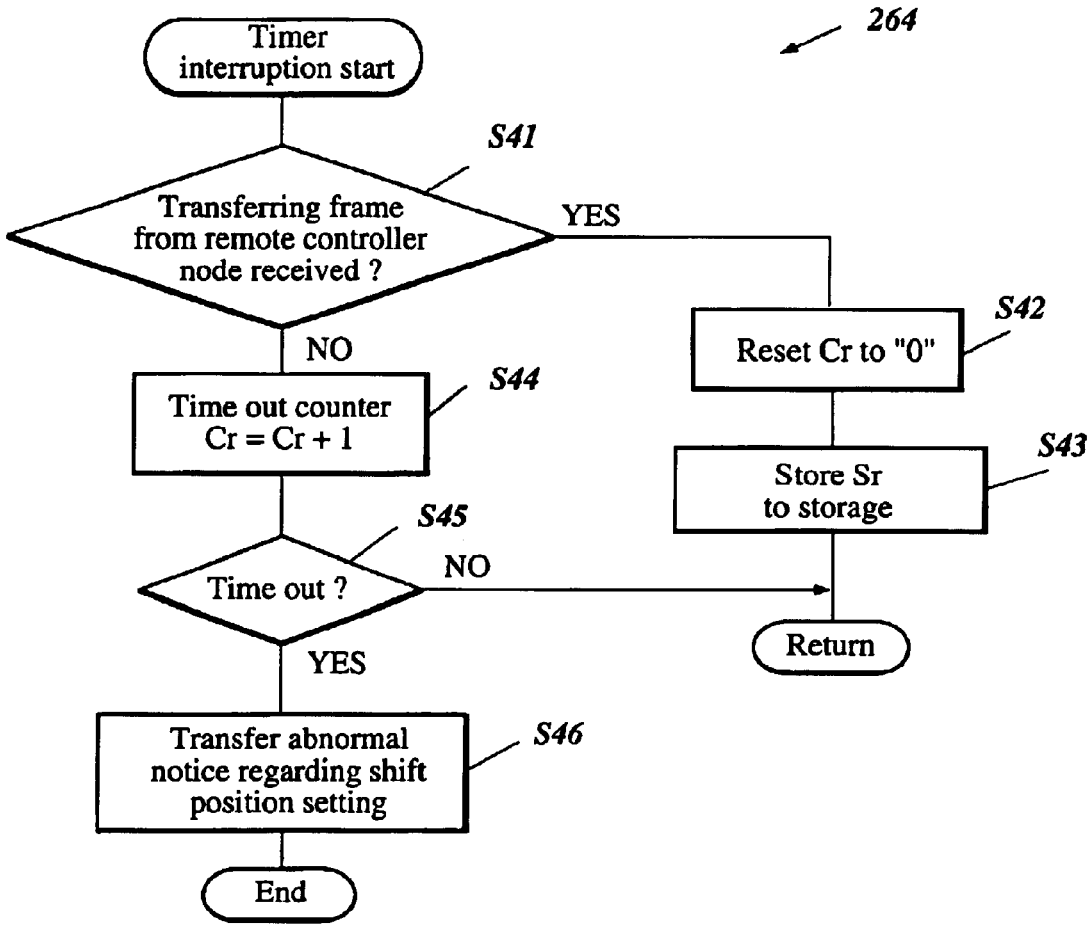
FIG. 10 illustrates a flow chart of an embodiment of a timer interruption program for a command reading process of the shift control node that is executed after receiving a transfer frame from the remote controller node.
Figure 11:
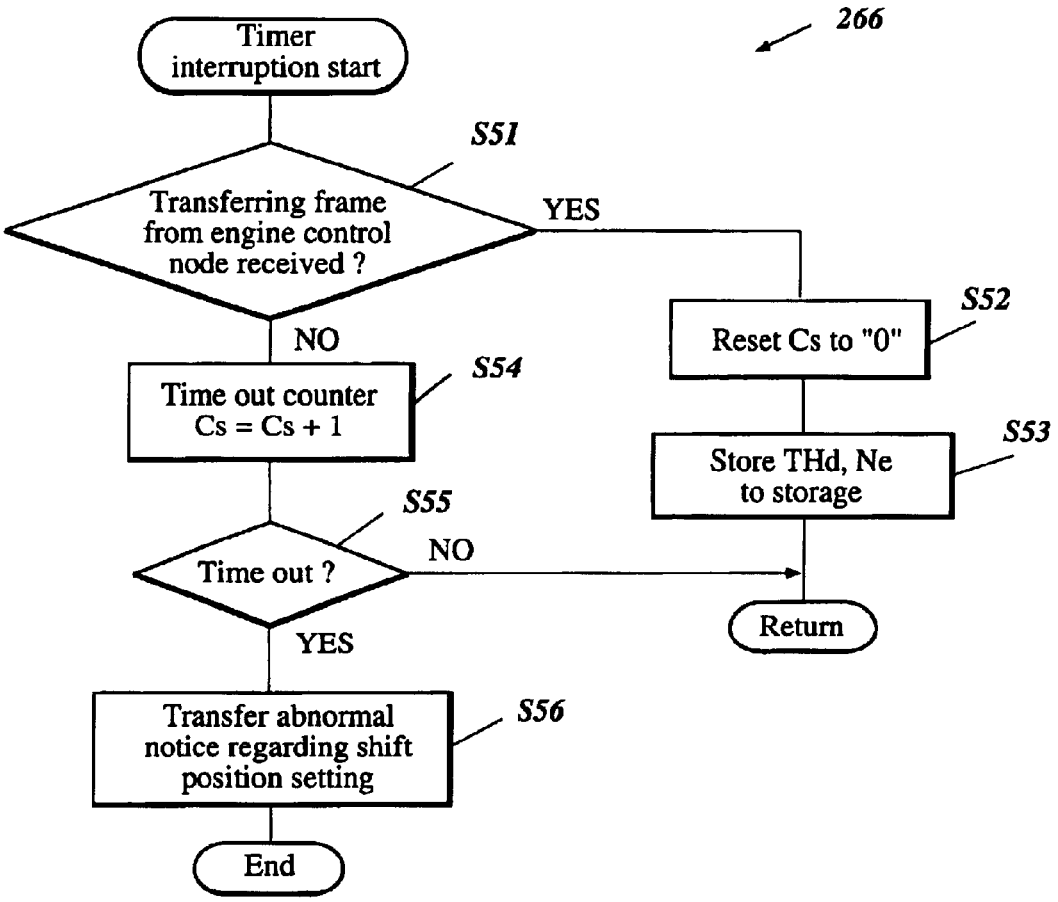
FIG. 11 illustrates a flow chart of an embodiment of a timer interruption program for an engine control node data reading process of the shift control node that is conducted after receiving a transfer frame from the engine control node.
Figure 12:
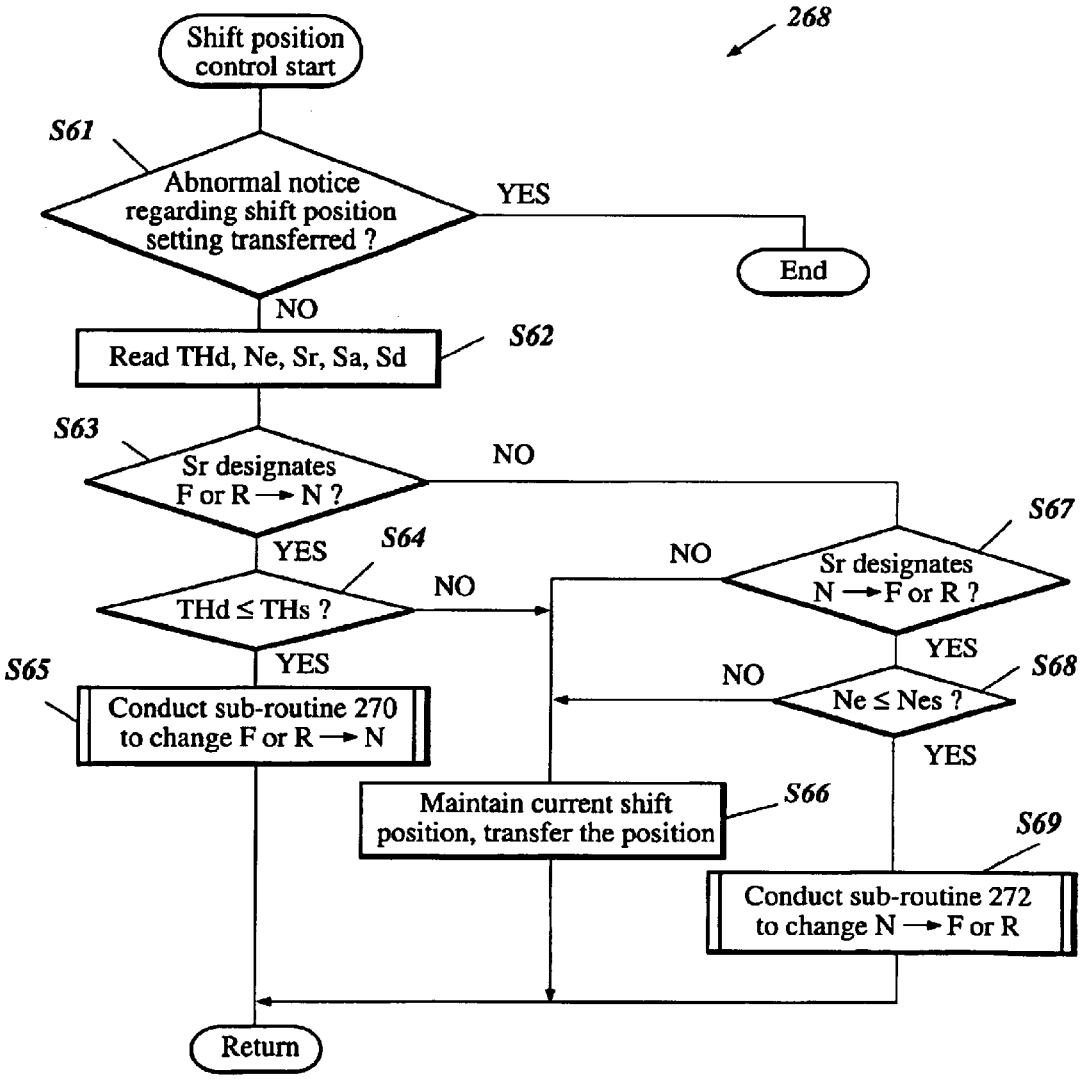
FIG. 12 illustrates a flow chart of an embodiment of a primary control program for a shift position setting process of the shift control node to change modes of the propeller by the changeover mechanism.

With reference to FIGS. 10–12, the microcomputer 176 of the shift control node 134 conducts a command reading process (FIG. 10) to read the shift position command Sr transferred from the remote control node 140; an engine control node data reading process (FIG. 11) to read the actual throttle valve position THd and the engine speed Ne transferred from the engine control node 98; and a shift position setting process (FIG. 12).

With reference to FIG. 10, the command reading process preferably is conducted by a timer interruption program 264. The shift control node 134 interrupts a primary control program, which is already running, every preset time period (e.g., 10 msec) to execute the timer interruption program 264.

The shift control node 134, at the step S41, determines whether a transferring frame that has the data field including a throttle valve position command THr and a shift position command Sr has been received from the remote controller node 140. If the determination is positive, the program 264 goes to a step S42 and resets a count value Cr of the timeout counter to "0." The program 264 then goes to a step S43.

The shift control node 134, at the step S43, extracts the shift position command Sr from the data field of the transferring frame and stores the shift position command Sr into the storage of the computing processing unit 184. The program 264 temporarily ends and returns control to the primary control program.

If the determination at the step S41 is negative, i.e., the transferring frame has not been received yet from the remote controller node 140, the program 264 goes to a step S44 and increments the counter value Cr of the timeout counter by "1." Then, the program 264 goes to a step S45 and determines whether the count value Cr of the timeout counter has reached a preset number. If the determination is negative, meaning that a preset timeout period has not elapsed, the program 264 temporarily ends and returns control to the primary control program.

If the determination at the step S45 is positive, the shift control node 134 recognizes that a necessary transferring frame was not obtained from the remote controller node 140 within the preset time and the program 264 goes to a step S46. The shift control node 134, at the step S46, creates a transferring frame that has an abnormal notice regarding the shift position setting in the data field and transfers the frame to the bus 166. The program 264 ends afterwards.

The shift control node 134 can warn the operator of the abnormal condition occurs by the display unit 156 or by a buzzer using the primary control program or another program that may include a step for the warning.

With reference to FIG. 11, the engine control data reading process preferably is conducted by a timer interruption program 266. The shift control node 134 interrupts the primary control program every preset time period (e.g., 10 msec) to conduct the timer interruption program 266.

The shift control node 134, at the step S51, determines whether a transferring frame that has the data field including an actual throttle valve position THd and an engine speed Ne has been received from the engine control node 98. If the determination is positive, the program 266 goes to a step S52 and resets a count value Cs of the timeout counter to "0." The program 266 then goes to a step S53.

The shift control node 134, at the step S53, extracts the actual throttle valve position THd and the engine speed Ne from the data field of the transferring frame and stores the actual throttle valve position THd and the engine speed Ne into the storage of the computing processing unit 184. The program 266 then temporarily ends and returns control to the primary control program.

If the determination at the step S51 is negative, i.e., the transferring frame has not been received yet from the engine control node 98, the program 266 goes to a step S54 and increments the counter value Cs of the timeout counter by "1." Then, the program 266 goes to a step S55 and determines whether the count value Cs of the timeout counter has reached a preset number. If the determination is negative, indicating that a preset timeout period has not elapsed, the program 266 temporarily ends and returns control to the primary control program.

If the determination at the step S55 is positive, meaning that a necessary transferring frame was not obtained from the engine control node 98 within the preset time, the program 266 goes to a step S56. The shift control node 134, at the step S56, creates a transferring frame that has an abnormal notice regarding the shift position setting in the data filed and transfers the frame to the bus 166. The program 266 ends afterwards. The shift control node 134 can warn the operator of the abnormal condition by the display unit 156 or by a buzzer using the primary control program or another program that may include a step for the warning.

With reference to FIG. 12, the shift position setting process preferably is conducted by the primary control program, which now is indicated by the reference numeral 268.

The shift control node 134 determines whether the abnormal notice regarding the shift position setting has been transferred. If the determination is positive, the program 268 ends. If the determination is negative, the program 268 goes to a step S62.

At the step S62, the shift control node 134 reads the actual throttle valve position THd, the shift position command Sr, the actual shift position domain Sa and the engine speed Ne that are stored in the storage of the computing processing unit 184. The program 266 then goes to a step S63 and determines whether the shift position command Sr has changed to the neutral position N from either the forward troll position F or reverse troll position R. If the determination is positive, the program 268 goes to a step S64.

At the step S64, the shift control node 134 determines whether the actual throttle valve position THd is equal to or less than an adjacent position to fully closed position THs. The adjacent position to fully closed position THs is a position adjacent to the fully closed position of the throttle valves 74 in this embodiment. For example, an open degree rate that is approximately 5% of the fully open degree is the adjacent position to fully closed position THs. If the determination at the step S64 is positive, the program 268 goes to a step S65.

Figure 13:
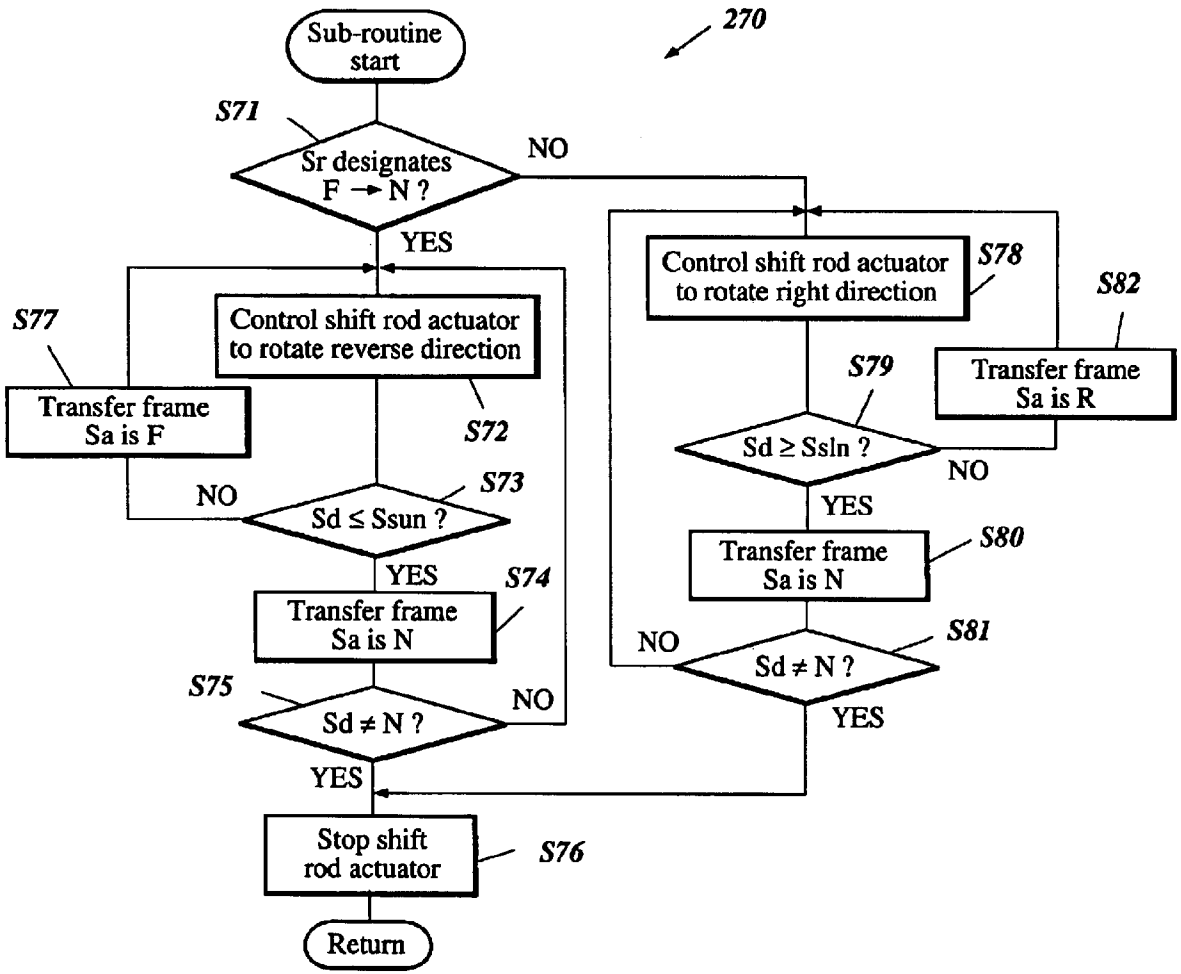
FIG. 13 illustrates a flow chart of an embodiment of a sub-routine program that controls a change process of the propeller to a neutral mode from a forward or reverse mode that is a step of the flow chart of FIG. 12.

The step S65 is a sub-routine program 270 of the primary control program 268 and is illustrated in FIG. 13. The sub-routine program 270 will be described shortly. The program 268 thus goes to the sub-routine program 270 and returns back to the step S61 after the shift control node 134 executes the sub-routine program 270.

If the determination at the step S64 is negative, i.e., the actual throttle valve position THd is greater than the adjacent position to fully closed position THs, the program 268 goes to a step S66.

At the step S66, the shift control node 134 controls the shift rod actuator 130 to maintain the current shift position Sd. The shift control node 134 also creates a transferring frame that has the shift position Sd in the data field and transfers the frame to the bus 166. Then, the program 268 returns back to the step S61 and the shift control node 134 conducts the step S61 again.

If the determination at the step S63 is negative, the program 268 goes to a step S67. The shift control node 134, at the step S67, determines whether the shift position command Sr has changed to either the forward troll position F or reverse troll position R from the neutral position N. If the determination is negative, the program 268 goes to the step S66.

If the determination at the step S67 is positive, the program 268 goes to a step S68 and determines whether the engine speed Ne is equal to or less than a low engine speed Nes that is next to "0." The engine operation is closer to stopping at the low engine speed Nes. For example, the low engine speed Nes is approximately 1,000 $min^{-1}$ (or rpm). If the determination at the step S68 is negative, the program 268 goes to the step S66.

Figure 14:
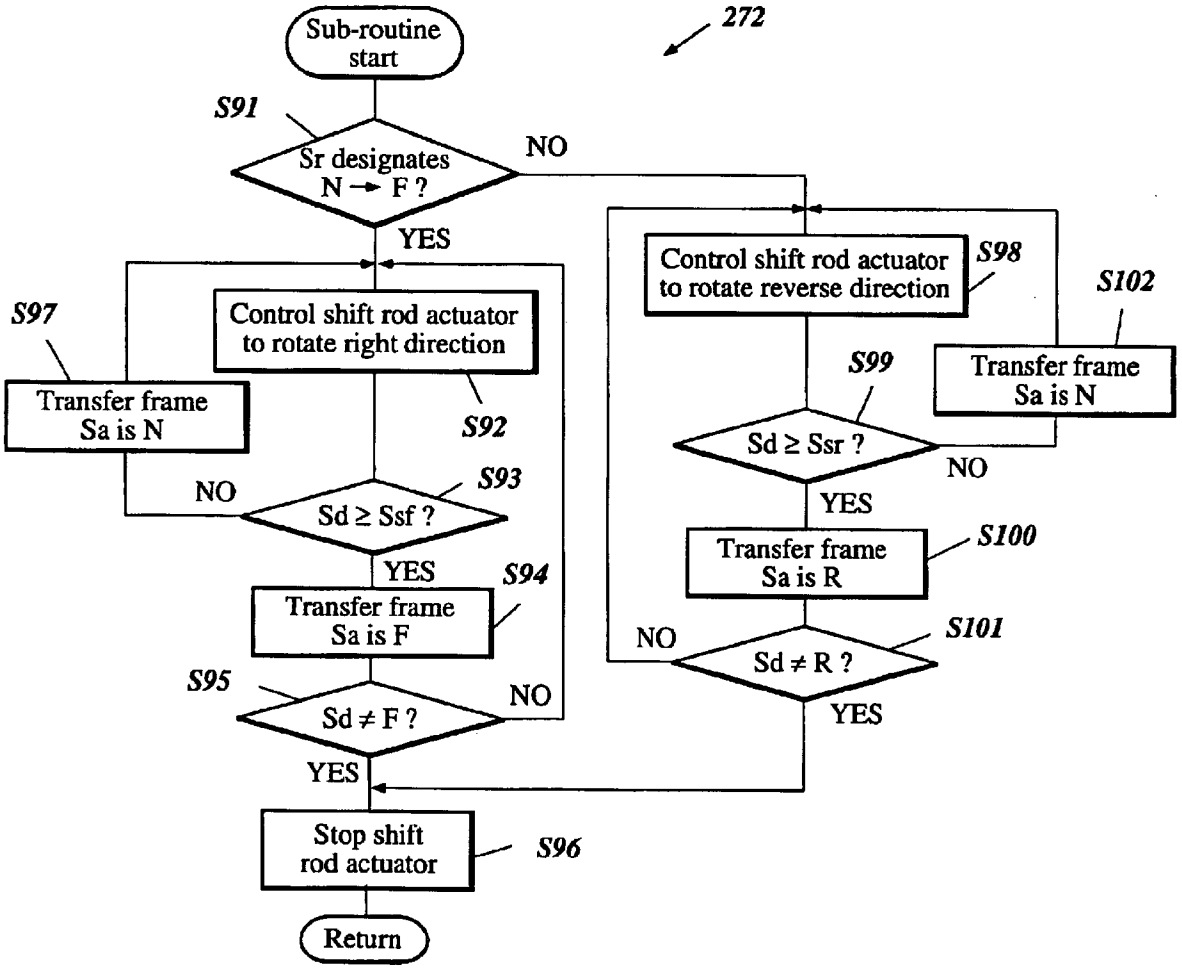
FIG. 14 illustrates a flow chart of an embodiment of a sub-routine program that controls a change process of the propeller to the forward or reverse mode from the neutral mode that is another step of the flow chart of FIG. 12.

If the determination at the step S68 is positive, the program 268 goes to a step S69, which is a sub-routine program 272 of the primary control program 268 and is illustrated in FIG. 14. The sub-routine program 272 will be described shortly. The program 268 thus goes to the sub-routine program 272 and returns back to the step S61 after the shift control node 134 executes the sub-routine program 272.

With reference to FIG. 13, the sub-routine program 270 now is described below. At the step S71, the shift control node 134 determines whether the shift position command Sr has changed to the neutral position N from the forward troll position F. If the determination at the step S71 is positive, the program 270 goes to a step S72.

At the step S72, the shift control node 134 controls the shift rod actuator 130 to actuate the shift rod 126 for the reverse directional rotation. The shift cam 128 moves the dog clutch unit to disengage from the forward bevel gear 120. The program 270 then goes to a step S73.

The shift control node 134, at the step S73, determines whether the actual shift position Sd sensed by the shift rod angle position sensor 136 is equal to or less than an upper neutral limit Ssun that regulates the upper end of a neutral domain. As noted above, in this embodiment, the most accelerated position of the reverse acceleration range GR provides the reference level of the determination. If the determination at the step S73 is positive, the program 270 goes to a step S74.

At the step S74, the shift control node 134 creates a transferring frame that has the neutral position N as the shift position domain Sa in the data field and transfers the frame to the bus 166. The program 270 then goes to a step S75 and determines whether the actual shift position Sd is almost equal to the neutral position N. If the determination is positive, the program 270 goes to a step S76 and stops the shift rod actuator 130. Then, the program 270 returns back to the step S61 of the primary control program 268 of FIG. 12.

If the determination at the step S75 is negative, i.e., the actual shift position Sd is greater than the neutral position N, the program 270 goes back to the step S72.

If the determination at the step S73 is negative, i.e., the actual shift position Sd is greater than the upper neutral limit Ssun of the neutral domain, the program 270 goes to a step S77. At the step S77, the shift control node 134 creates a transferring frame that has a forward position F as the shift position domain Sa in the data field and transfers the frame to the bus 166. The program 270 then goes back to the step S72.

On the other hand, if the determination at the step S71 is negative, the program 270 goes to a step S78. At the step S78, the shift control node 134 controls the shift rod actuator 130 to actuate the shift rod 126 for the right directional rotation. The shift cam 128 moves the dog clutch unit to disengage from the reverse bevel gear 122. The program 270 goes to a step S79.

The shift control node 134, at the step S79, determines whether the actual shift position Sd sensed by the shift rod angle position sensor 136 is equal to or greater than an lower neutral limit Ssln that regulates the lower-most end of the neutral domain. If the determination at the step S79 is positive, the program 270 goes to a step S80.

At the step S80, the shift control node 134 creates a transferring frame that has the position N as the shift position domain Sa in the data field and transfers the frame to the bus 166. The program 270 then goes to a step S81.

The shift control node 134, at the step S81, determines whether the actual shift position Sd is almost equal to the neutral position N. If the determination is positive, the program 270 goes to the step S76.

If the determination at the step S81 is negative, i.e., the actual shift position Sd is less than the neutral position N, the program 270 goes back to the step S78.

If the determination at the step S79 is negative, i.e., the actual shift position Sd is less than the lower neutral limit Ssln of the neutral domain, the program 270 goes to a step S82. At the step S82, the shift control node 134 creates a transferring frame that has a reverse position R as the shift position domain Sa in the data field and transfers the frame to the bus 166. The program 270 then goes back to the step S78.

With reference to FIG. 14, the sub-routine program 272 now is described below.

At the step S91, the shift control node 134 determines whether the shift position command Sr is changed to the forward position F from the neutral position N. If the determination at the step S91 is positive, the program 272 goes to a step S92 and controls the shift rod actuator 130 to actuate the shift rod 126 for the right directional rotation. The shift cam 128 moves the dog clutch unit to engage with the forward bevel gear 120. The program 272 then goes to a step S93 and determines whether the actual shift position Sd sensed by the shift rod angle position sensor 136 is equal to or greater than a forward limit Ssf that regulates a forward domain. If the determination at the step S93 is positive, the program 272 goes to a step S94.

At the step S94, the shift control node 134 creates a transferring frame that has the forward position F as the shift position domain Sa in the data field and transfers the frame to the bus 166. The program 272 then goes to a step S95 and determines whether the actual shift position Sd is almost equal to the forward position F. If the determination is positive, the program 272 goes to a step S96 stops the shift rod actuator 130. Then, the program 272 returns back to the step S61 of the primary control program 268 of FIG. 12.

If the determination at the step S95 is negative, i.e., the actual shift position Sd is less than the forward position F, the program 272 goes back to the step S92 and the shift control node 134 performs step S92.

If the determination at the step S93 is negative, i.e., the actual shift position Sd is less than the forward limit Ssf of the forward domain, the program 272 goes to a step S97. At the step S97, the shift control node 134 creates a transferring frame that has a neutral position N as the shift position domain Sa in the data field and transfers the frame to the bus 166. The program 272 then goes back to the step S92.

On the other hand, if the determination at the step S91 is negative, the program 272 goes to a step S98. At the step S98, the shift control node 134 controls the shift rod actuator 130 to actuate the shift rod 126 for the reverse directional rotation. The shift cam 128 moves the dog clutch unit to engage with the reverse bevel gear 122. The program 272 goes to a step S99.

The shift control node 134, at the step S99, determines whether the actual shift position Sd sensed by the shift rod angle position sensor 136 is equal to or less than a reverse limit Ssr that regulates the reverse domain. If the determination at the step S99 is positive, the program 272 goes to a step S100.

At the step S100, the shift control node 134 creates a transferring frame that has the reverse position R as the shift position domain Sa in the data field and transfers the frame to the bus 166. The program 272 then goes to a step S101.

The shift control node 134, at the step S101, determines whether the actual shift position Sd is almost equal to the reverse troll position R. If the determination is positive, the program 272 goes to the step S96.

If the determination at the step S101 is negative, i.e., the actual shift position Sd is greater than the reverse position R, the program 272 goes back to the step S98.

If the determination at the step S99 is negative, i.e., the actual shift position Sd is greater than the reverse limit Ssr, the program 272 goes to a step S102. At the step S102, the shift control node 134 creates a transferring frame that has the neutral position N as the shift position domain Sa in the data field and transfers the frame to the bus 166. The program 272 then goes back to the step S98.

Figure 15:
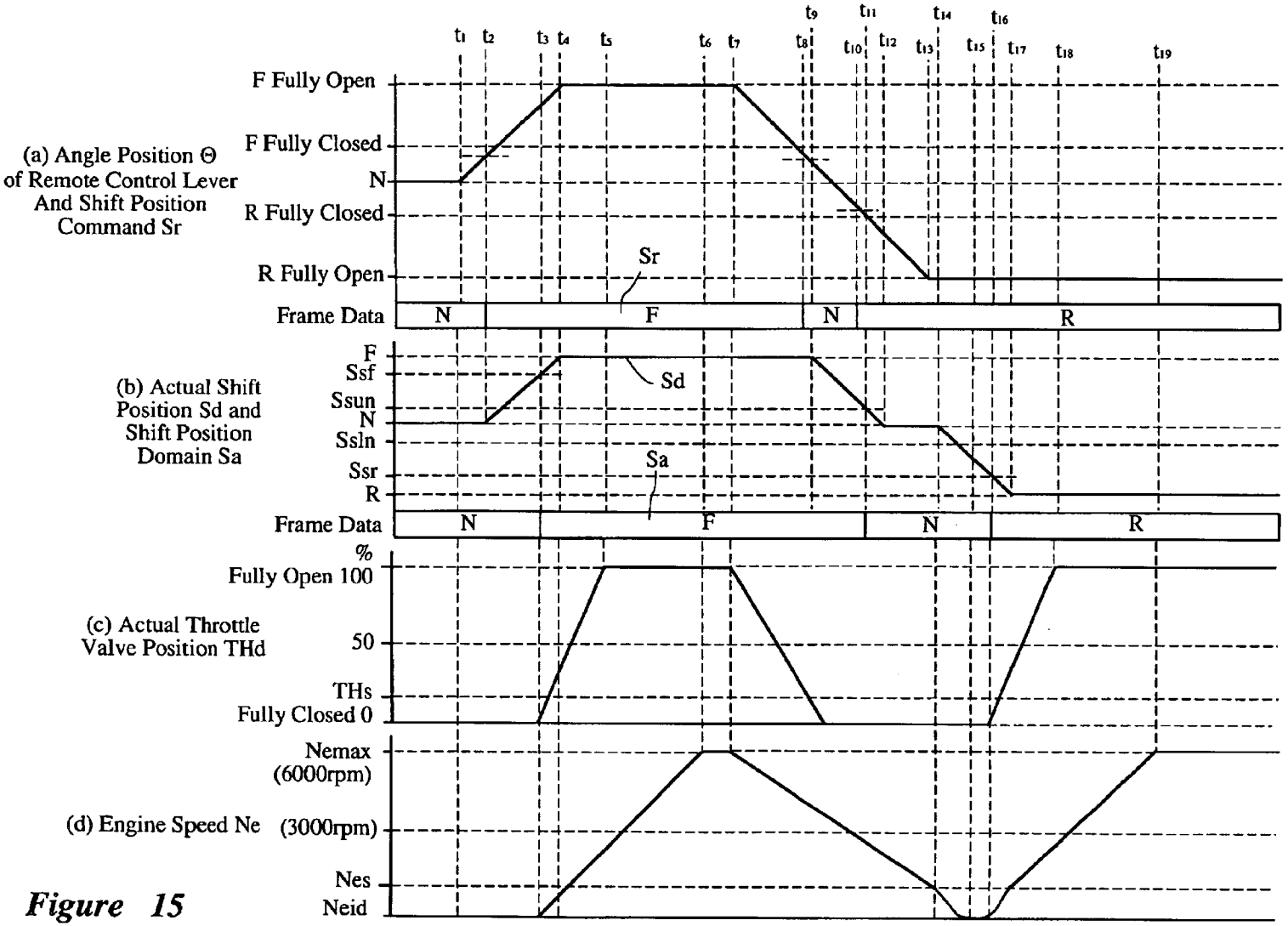
FIG. 15 illustrates a time chart of exemplary transitions when the operator moderately operates a control lever of the remote controller, wherein the part (a) shows a transition of the control lever of the remote controller, the part (b) shows a transition of an actual mode of the propeller, the part (c) shows a transition of an actual throttle valve position and the part (d) shows a transition of an engine speed, the parts (a)–(d) have a common time flow, and the time elapses from the left-hand side to the right-hand side of FIG. 15.
Figure 16:
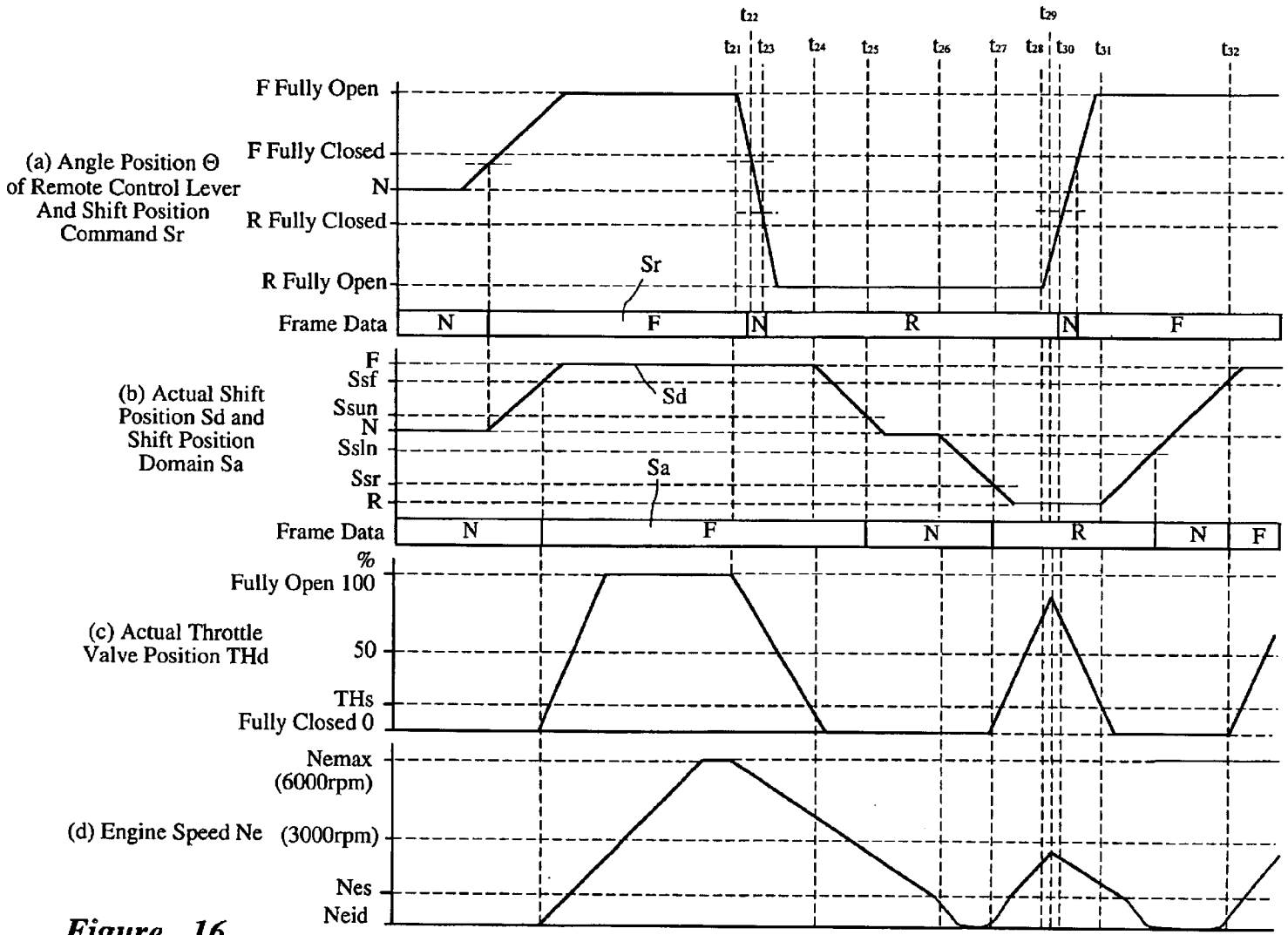
FIG. 16 illustrates a time chart of exemplary transitions when the operator abruptly operates the control lever of the remote controller, wherein the part (a) shows a transition of the control lever of the remote controller, the part (b) shows a transition of an actual mode of the propeller, the part (c) shows a transition of an actual throttle valve position and the part (d) shows a transition of an engine speed, the parts (a)–(d) have a common time flow, and the time elapses from the left-hand side to the right-hand side of FIG. 16.

With reference to FIG. 15, an exemplary operation by the engine control node 98 (or unit 96) and the shift control node 134 (or unit 132) while the operator moderately operates the control lever 142 of the remote controller 138 will be described below. The part (a) of FIG. 15 illustrates a transition of the angle position è of the control lever 142 and a transition of the shift position command Sr; the part (b) of FIG. 15 illustrates a transition of the actual shift position Sd and a transition of the actual shift domain Sa; the part (C) of FIG. 15 illustrates a transition of the actual throttle valve position THd; and the part (d) of FIG. 16 illustrates an transition of the engine speed Ne.

As described above, the shift position command Sr is determined based upon the position è of the control lever 142 of the remote controller. As shown in the part (a) of FIG. 15, the reverse position R of the shift position command Sr corresponds to a range of the lever position è between the most accelerated position of the reverse acceleration range GR (indicated by the phrase "R fully open" of FIG. 15) and almost the least accelerated position of the reverse acceleration range GR that is substantially equal to the reverse troll position R (indicated by the phrase "R fully closed" of FIG. 15). The forward position F of the shift position command Sr corresponds to a range of the lever position è between the most accelerated position of the forward acceleration range GF (indicated by the phrase "F fully open" of FIG. 15) and almost the least accelerated position of the forward acceleration range GF that is substantially equal to the forward troll position F (indicated by the phrase "F fully closed" of FIG. 15). The neutral position N of the shift position command Sr corresponds to a range of the lever position è between almost the reverse troll position R and almost the forward troll position F. The language "almost" means that the limit ends are located slightly within the neutral range.

Initially, the main switch unit at the display unit 156 is in an OFF position. Under this initial condition, none of the nodes 98, 134, 140, 148, 162, 168, actuators or sensors are activated. Also, the control lever 142 of the remote controller 138 is in the neutral position N. The engine 38 does not operate and the watercraft 30 is not propelled.

The operator inserts the main switch key into the switch key recess 160 on the display unit 156 and rotates the switch key to an ON position, causing the nodes 98, 134, 140, 148, 162, 168, actuators and sensors to be activated. The management node 168 assigns network addresses to the respective terminal nodes 98, 134, 140, 148, 162 and then the nodes 98, 134, 140, 148, 162, 168 are able to communicate with each other.

The operator further rotates the main switch key to a START position and the engine 38 is started. The remote controller node 140 creates a transferring frame that has a shift position command Sr designating the neutral position N and a throttle valve position command THr designating the fully closed position (open degree 0%) in the data field. The remote controller node 140 then transfers the frame to the engine control node 98 and the shift control node 134 through the bus 166.

The shift control node 134 executes the primary control program 268 of FIG. 12 for the shift position setting process. Under a normal condition in which the shift control node 134 normally receives the transferring frames from the remote controller node 140 and the engine control node 98, the shift control node 134 reads the actual throttle valve position THd, the shift position command Sr and the engine speed Ne (the step S62). The shift control node 134 also reads the actual shift domain Sa that the shift control node 134 has set previously (the step S62).

The determinations at the steps S63 and S67 are negative because the shift position is not changed so far. The shift control node 134 thus sets the neutral position N of the shift control command Sr as a current shift control value Sc and controls the shift rod actuator 130 with the shift control value Sc (the step S66). The shift rod actuator 130 does not operate and the shift rod 126 maintains the present position because the shift rod 126 is already located at the neutral position N. The shift control node 134 creates a transferring frame that has the shift position domain Sa designating the neutral position N in the data field and transfers the frame to the bus 166.

On the other hand, the engine control node 98 executes the program 260 of FIG. 9 for the throttle valve position setting process. Under a normal condition in which the engine control node 98 normally receives the transferring frames from the remote controller node 140 and the shift control node 134, the engine control node 98 reads the throttle valve position command THr, the shift position command Sr and the shift position domain Sa (the step S22). The shift control node 134 also reads the actual throttle valve position THd sensed by the throttle valve position sensor 103 (the step S22).

The determination at the step S23 is negative because the shift position command Sr is equal to the shift position domain Sa. The engine control node 98 sets the throttle valve position command THr as the current throttle valve position control value THc(n) (the step S25). Because the current throttle valve position control value THc(n) is the same as the immediately previous throttle valve position control value THc(n−1), the difference ÄTH is "0" (the step S26). Accordingly, the determination at the step S27 is negative as there there is no decrease tendency (the step S31). Thus, the engine control node 98 controls the throttle valve actuator 76 using the throttle valve position command THr, which designates the fully closed position, as the current throttle valve position control value THc(n) (the step S30).

Under the initial condition, the position è of the control lever 142 of the remote controller 138 is the neutral position N, the shift position command Sr designates the neutral position N, and the throttle valve position command THr designates the fully closed position (the part (a) of FIG. 15);

the actual shift position Sd is the neutral position N and the shift position domain Sa designates the neutral position N (the part (b) of FIG. 15); and the actual throttle valve position THd is the fully closed position (the part (c) of FIG. 15). Because the engine control node 98 (or unit 96) controls the fuel injection timing and duration and the ignition timing in accordance with the throttle valve position THd, the engine speed under the condition is an idle speed Neid (the part (d) of FIG. 15).

Assuming that the operator starts operating the control lever 142 to the forward troll position F from the neutral position N at the timing t1 of FIG. 15, the angle position è of the control lever 142 sensed by the control lever angle position sensor 144 starts increasing. The shift position command Sr thus is changed to the forward position F from the neutral position N at a threshold located immediately under the angle position è at the forward troll position F ("F fully closed position" of FIG. 15 or the least accelerated position of the forward acceleration range GF). In other words, the change to the forward position F occurs at the timing t2. The shift control node 134 creates a transferring frame that has the shift position command Sr designating the shift position F in the data field and transfers the frame to the bus 166.

The determination at the step S67 of the program 268 of FIG. 12 thus is positive. The next determination at the step S68 is negative because the engine speed Ne is at the idle speed Neid and less than the preset engine speed Nes as shown in the part (d) of FIG. 15. The program 268 goes to the step S69 and the shift control node 134 conducts the sub-routine program 272 of FIG. 14.

Because the shift position command Sr designates the change to the forward position F from the neutral position N, the determination at the step S91 of the program 272 is positive, the shift control node 134 controls the shift rod actuator 130 to actuate the shift rod 126 for the forward directional rotation. The shift cam 128 moves the dog clutch unit to engage with the forward bevel gear 120.

In response to the right directional rotation of the shift rod actuator 130, the actual shift position Sd sensed by the shift rod angle position sensor 136 starts increasing toward the forward position F as shown in the part (b) of FIG. 15. However, the determination at the step S93 of the program 272 is negative until the actual shift position Sd exceeds the forward limit Ssf of the forward domain (the step S93). The shift control node 134 thus controls the shift rod actuator 130 to maintain the neutral position N. The shift control node 134 also creates the transferring frame that has the shift position domain Sa designating the neutral position N in the data field and transfers the frame to the bus 166 (the step S97).

The determination at the step S23 of the program 260 of FIG. 9 is positive at the timing t2. The engine control node 98 sets the current throttle valve position control value THc(n) to "0" (the step S24). Because the current throttle valve position control value THc(n) is still the same as the immediately previous throttle valve position control value THc(n−1), the engine control node 98 controls the throttle valve actuator 76 with the current throttle valve position control value THc(n) designating "0" or at the fully closed position (the steps S26–S30). The actual throttle valve position THd thus is maintained at the fully closed position at the timing t2 as shown in the part (c) of FIG. 15. Accordingly, the engine speed Ne is maintained at the idle speed Neid as shown in the part (d) of FIG. 15.

The actual shift position Sd exceeds the forward limit Ssf of the forward domain at the timing t3. The determination at the step S93 of the program 272 of FIG. 14 now is positive. The shift control node 134 creates the transferring frame that has the shift position domain Sa designating the shift position F in the data field as shown in the part (b) of FIG. 15 and transfers the frame to the bus 166 (the step S94).

The determination at the step S23 of the program 260 of FIG. 9 becomes negative because the shift position command Sr becomes equal to the shift position domain Sa. The engine control node 98 sets the throttle valve position command THr as the current throttle valve position control value THc(n) (the step S25). At the timing t3, the control lever 142 has reached a position è that is close to the fully accelerated position of the forward acceleration range GF. Thus, the engine control node 98 has created and transferred a transferring frame that has the throttle valve position command THr designating an almost fully open position in the data field at the timing t3.

Because the immediately previous throttle valve position control value THc(n−1) was "0" and the current throttle valve position control value THc(n) is a large amount corresponding to the lever position è that is close to the fully accelerated position of the forward acceleration range GF, the difference ÄTH is greater than the preset increase threshold value ÄTHa (the steps S26–S28). Accordingly, the current throttle valve position control value THc(n) is calculated by adding the preset increase threshold value ÄTHa to the immediately previous throttle valve position control value THc(n−1) at the step S29.

The engine control node 98 thus controls the throttle valve actuator 76 with the calculated current throttle valve position control value THc(n). The actual throttle valve position THd starts gradually increasing at the timing t3 as shown in the part (c) of FIG. 15. In response to the gradual increase of the throttle valve position THd, the engine speed Ne starts increasing as shown in the part (d) of FIG. 15. An increase rate of the engine speed Ne is smaller than an increase rate of the throttle valve position THd.

The remote control lever 142 reaches the most accelerated position ("F fully open") of the forward acceleration range GF at the timing t4 as shown in the part (a) of FIG. 15. The operator keeps the remote control lever 142 at the most accelerated position for awhile. The actual shift position Sd also reaches the most accelerated forward position F at the timing t4 as shown in the part (b) of FIG. 15. The throttle valve position THd continues increasing and reaches the fully open position (open degree 100%) at the timing t5 as shown in the part (c) of FIG. 15. The engine speed Ne in turn further continues increasing and reaches the maximum speed Nemax, which is approximately 6,000 rpm, for example, at the timing t6 as shown in the part (d) of FIG. 15.

The operator then starts moderately returning the remote control lever 142 toward the neutral position N at the timing t7. The determination at the step S23 of the program 260 of FIG. 9 is negative because the shift position command Sr is consistent with the shift position domain Sa at the timing t7. The throttle valve position command THr thus is applied as the current throttle valve position control value THc(n) at the step S25. The engine control node 98 controls the throttle valve actuator 76 to gradually decrease the throttle valve position THd as shown in the part (c) of FIG. 15. The engine speed Ne also starts decreasing at the timing t7 as shown in the part (d) of FIG. 15. A decrease rate of the engine speed Ne is smaller than a decrease rate of the throttle valve position THd.

Both of the determinations at the steps S63 and S67 of the program 268 of FIG. 12 are negative at the timing t7 because the shift position command Sr maintains the forward position F as shown in the part (a) of FIG. 15. The shift control node 134 thus maintains the forward position F of the shift position domain Sa in accordance with the shift position Sr designating the forward position F at the step S66.

The shift position command Sr changes to the neutral position N at the timing t8 because the angle position è of the remote control lever 42 decreases to the threshold located immediately lower than the "F fully closed position." The determination at the step S63 of the program 268 of FIG. 12 now is positive. The determination at the step S64 is negative because the actual throttle valve position THd is greater than the adjacent position to fully closed position THs at the timing t8 as shown in the part (c) of FIG. 15. The shift control node 134 thus maintains the shift position domain Sa at the forward position F as shown in the part (b) of FIG. 15.

On the other hand, the determination at the step S23 of the program 260 of FIG. 9 becomes positive because the shift position domain Sa becomes inconsistent with the shift position command Sr at the timing t8. The engine control node 98 thus sets the current throttle valve position control value THc(n) to "0" (the step S24). The determination at the step S27 is negative because the current throttle valve position control value THc(n) is less than the immediately previous throttle valve position control value THc(n−1). The determination at the step S31 is positive because the absolute value of the difference ÄTH that is calculated at the step S26 is greater than the preset decrease threshold value ÄTHd because the throttle valve position THd is approximately 25% at the timing t8 as shown in the part (c) of FIG. 15.

The engine control node 98 calculates the current throttle valve position control value THc(n) by subtracting the preset decrease threshold value ÄTHd from the immediately previous throttle valve position control value THc(n−1) at the step S32 and controls the throttle valve actuator 76 with the calculated current throttle valve position control value THc (n) at the step S30. The actual throttle valve position THd thus continues decreasing and reaches the fully closed position (open degree 0%) later as shown in the part (c) of FIG. 15. The engine speed Ne also continues decreasing.

The throttle valve position THd becomes equal to the adjacent position to fully closed position THs at the timing t9 immediately after the timing t8. The determination at the step S64 of the program 268 of FIG. 12 now is positive. The shift control node 134 thus conducts the step S65 that is the sub-routine program 270 of FIG. 13. The determination at the step S71 of the program 270 is positive. The shift control node 134 controls the shift rod actuator 130 to actuate the shift rod 126 for the reverse directional rotation. Thus, the shift position signal Sd sensed by the shift rod angle position sensor 136 starts gradually decreasing at the timing t8 as shown in the part (b) of FIG. 15 and the dog clutch unit is gradually disengaging from the forward bevel gear 120.

The shift control position command Sr changes to the reverse position R at the timing t10 because the lever position è reaches a threshold located immediately above the angle position è at the reverse troll position R ("R fully closed position" of FIG. 15 or the least accelerated position of the reverse acceleration range GR). The determination at the step S73 of the program 270 of FIG. 13 is negative at the timing t10 and the shift position domain Sa is still the forward position F.

The determination at the step S73 becomes positive at the timing t11 because the shift position Sd becomes equal to the upper neutral limit Ssun of the shift position domain Sa. The shift control node 134 changes the shift position domain Sa to the neutral position N and creates the transferring frame that has the shift position domain Sa designating the neutral position N and transfers the frame to the bus 166 at the step S74.

The determination at the step S23 of the program 260 of FIG. 9 is positive at the timing t11 because the shift position domain Sa is inconsistent with the shift position command Sr. The engine control node 98 thus controls the throttle valve actuator 76 to keep the fully closed position (the steps S24, S26, S27, S31 and S30). The throttle valve position THd continues to be the fully closed position at the timing t11 as shown in the part (c) of FIG. 15. The engine speed Ne also continues decreasing as shown in the part (d) of FIG. 15.

The shift position Sd reaches the neutral position N at the timing t12 as shown in the part (a) of FIG. 15. The determination at the step S75 of the program 270 of FIG. 13 is positive. Thus, the shift control node 134 stops the shift rod actuator 130 at the step S76. The shift position Sd stays at the neutral position N.

The determination at the step S23 of the program 260 of FIG. 9 is still positive because the shift position domain Sa is inconsistent with the shift position command Sr at the timing t12. The throttle valve position THd stays at the fully closed position and the engine speed Ne continues decreasing.

The determination at the step S67 of the program 268 of FIG. 12 is positive at the timing t12 because the shift position command Sr has been changed to the reverse position R from the neutral position N. The determination at the step S68 is negative because the engine speed Ne is still above the low engine speed threshold Nes. The shift control node 134 maintains the neutral position N of the shift position domain Sa and transfers the frame that has the neutral position N of the shift position domain Sa at the step S66.

The remote control lever 142 reaches the fully accelerated position of the reverse acceleration range GR (R fully open) at the timing t13. The remote controller node 140 creates a transferring frame that has the throttle valve position command THr designating the fully open and the shift position command Sr designating the reverse position R and transfers the frame to the bus 166. The throttle valve position THd is maintained at the fully closed position and the engine speed Ne continues decreasing at the timing t13 because the determination at the step S23 of the program 260 of FIG. 9 is still positive.

The engine speed Ne reaches the low engine speed threshold Nes at the timing t14. The determination at the step S68 now is positive. The shift control node 134 thus conducts the step S69 that is the sub-routine program 272 of FIG. 14. The determination at the step S91 of the program 272 is negative because the shift position command Sr is changed to the reverse position R from the neutral position N. The shift control node 134 controls the shift rod actuator 130 to actuate the shift rod 126 for the reverse directional rotation to engage the dog clutch unit with the reverse bevel gear 122 at the step S98. The shift position signal Sd thus starts decreasing at the timing t14 as shown in the part (b) of FIG. 15.

The engine speed Ne reaches the idle speed Neid at the timing 15 and stays at the idle speed Neid as shown in the part (d) of FIG. 15. The shift position Sd reaches the reverse limit Ssr of the reverse domain at the timing t16 as shown in the part (b) of FIG. 15. The determination at the step S99 of the program 272 of FIG. 14 thus is positive. The shift control node 134 changes the shift position domain Sa to the reverse position R at the timing t16 as shown in the part (b) of FIG. 15 and transfers the transferring frame that has the shift position domain Sa designating the reverse position R in the frame to the bus 166 at the step S100.

The determination at the step S23 of the program 260 of FIG. 9 becomes negative because the shift position domain Sa becomes consistent with the shift position command Sr at the timing t16. The throttle valve position command THr designating the fully open position (open degree 100%) is set to the current throttle valve position control value THc(n) at the step S25. The difference ÄTH is large enough to exceed the preset increase threshold value ÄTHa because the immediately previous throttle valve position control value THc(n−1) was "0." The determination at the step S28 thus is positive.

The engine control node 98 calculates the current throttle valve position control value THc(n) by adding the preset increase threshold value ÄTHa to the immediately previous throttle valve position control value THc(n−1) at the step S29. The engine control node 98 then controls the throttle valve actuator 76 using the calculated current throttle valve position control value THc(n) at the step S30. The throttle valve position THd thus starts gradually increasing at the timing t16 as shown in the part (c) of FIG. 15. The engine speed Ne starts increasing in response to the increase of the throttle valve position THd as shown in the part (d) of FIG. 15. The watercraft 30 proceeds backwardly in response to the engine speed Ne.

The shift position signal Sd reaches the fully accelerated position of the reverse acceleration range GR at the timing t17. The determination at the step S101 of the program 272 of FIG. 14 is positive. The shift control node 134 stops the shift rod actuator 130 at the step S96. The shift position domain Sa thus is maintained at the reverse position R at the timing t17 as shown in the part (b) of FIG. 15.

The throttle valve position THd continues increasing at the timing t17 and reaches the fully open position (open degree 100%) at the timing t18. The engine speed Ne also continues increasing at both the timing t17 and the timing t18 and reaches the maximum speed Nemax at the timing t19. The fully open state of the throttle valve position THd and the maximum speed Nemax of the engine speed continues afterwards unless the operator operates the remote control lever 142.

With reference to FIG. 16, an exemplary operation by the engine control node 98 (or unit 96) and the shift control node 134 (or unit 132) while the operator abruptly operates the control lever 142 of the remote controller 138 will be described below. Similar to FIG. 15, the part (a) of FIG. 16 illustrates a transition of the angle position è of the control lever 142 and a transition of the shift position command Sr; the part (b) of FIG. 16 illustrates a transition of the actual shift position Sd and a transition of the actual shift domain Sa; the part (C) of FIG. 16 illustrates a transition of the actual throttle valve position THd; and the part (d) of FIG. 16 illustrates an transition of the engine speed Ne.

The angle position è of the remote control lever 142, the shift position command Sr, the shift position signal Sd, the shift position domain Sa, the throttle valve position THd and the engine speed Ne in this example vary in the same way through timings t1–t6 as those described above and shown in the parts (a), (b), (c) and (d) of FIG. 15. Thus, the operation from the timing t1 to the timing t6 is not described repeatedly. The timing t21 is substantially the same as the timing t7 of FIG. 15.

The operator starts abruptly returning the remote control lever 142 toward the neutral position N at the timing t21. The shift position command Sr transferred from the remote controller node 140 is changed to the neutral position N at the timing t22 and further is changed to the reverse position R at the timing t23. The determination at the step S23 of the program 260 of FIG. 9 at the timing t21 becomes negative because the shift position domain Sa becomes consistent with the shift position command Sr at the timing t21. The throttle valve position THd starts decreasing at the timing t21 as shown in the part (c) of FIG. 16. The engine speed Ne also starts decreasing at the timing t21 as shown in the part (d) of FIG. 16. A decrease rate of the throttle valve position THd is smaller than a decrease rate of the angle position è of the remote control lever 142. Further, a decrease rate of the engine speed Ne is smaller than a decrease rate of the throttle valve position THd. The shift position domain Sa does not change even though the shift position command Sr changes to the neutral position N and further to the reverse position R. The condition is maintained at the timings t22 and t23.

The throttle valve position THd continues decreasing and becomes equal to the adjacent position to fully closed position THs at the timing t24. The determination at the step S64 of the program 268 of FIG. 12 now is positive. The shift control node 134 thus conducts the sub-routine program 270 of FIG. 13. The determination at the step S71 of the program 270 is positive at the timing t24 because the remote control lever 142 was changed to the neutral position N from the forward position F previously. The shift control node 134 controls the shift rod actuator 130 to actuate the shift rod 126 for the reverse directional rotation. Thus, the shift position signal Sd sensed by the shift rod angle position sensor 136 starts gradually decreasing at the timing t24 as shown in the part (b) of FIG. 16 and the dog clutch unit is gradually disengaging from the forward bevel gear 120.

The determination at the step S73 becomes positive at the timing t25 because the shift position Sd becomes equal to the upper neutral limit Ssun of the shift position domain Sa. The shift control node 134 changes the shift position domain Sa to the neutral position N and creates the transferring frame that has the shift position domain Sa designating the neutral position N and transfers the frame to the bus 166 at the step S74.

The engine speed Ne reaches the low engine speed threshold Nes at the timing t26. The determination at the step S68 of the program 268 of FIG. 12 becomes positive. The shift control node 134 thus conducts the sub-routine program 272 of FIG. 14. The determination at the step S91 of the program 272 is negative because the shift position command Sr was changed to the reverse position R from the neutral position N previously. The shift control node 134 controls the shift rod actuator 130 to actuate the shift rod 126 for the reverse directional rotation to engage the dog clutch unit with the reverse bevel gear 122 at the step S98. The shift position signal Sd thus starts decreasing at the timing t26 as shown in the part (b) of FIG. 16.

The shift position Sd reaches the reverse troll limit Ssr of the reverse troll domain at the timing t27 as shown in the part (b) of FIG. 16. The determination at the step S99 of the program 272 of FIG. 14 thus becomes positive. The shift control node 134 changes the shift position domain Sa to the reverse position R at the timing t27 as shown in the part (b) of FIG. 16 and transfers the transferring frame that has the shift position domain Sa designating the reverse position R in the frame to the bus 166 at the step S100.

At the step S23 of the program 260 of FIG. 9 becomes negative because the shift position domain Sa becomes consistent with the shift position command Sr at the timing t27. The throttle valve position THd starts increasing at the timing t27 as shown in the part (c) of FIG. 16. The engine speed Ne also starts increasing in response to the increase of the throttle valve position THd as shown in the part (d) of FIG. 16. The watercraft 30 proceeds backwardly in response to the engine speed Ne.

Then the operator abruptly starts operating the remote control lever 142 toward the forward position F at the timing t28 as shown in the part (a) of FIG. 16. The throttle valve position THd continues increasing until the throttle valve position command THr becomes consistent with the throttle valve position control value THc at the timing t29. After the timing t29, the throttle valve position THd and the engine speed Ne together decrease as shown in the parts (c) and (d) of FIG. 16.

The shift position command Sr changes to the neutral position N from the reverse position R at the timing t30. The throttle valve position THd continues decreasing because the throttle valve position control value THc(n) is set to "0."

The throttle valve position THd becomes consistent with the adjacent position to fully closed position THs at the timing t31. The shift control node 134 thus starts operating the shift rod actuator 130 toward the neutral position N. The throttle valve position THd continues decreasing to the fully closed position. The throttle valve position THd then reaches the fully closed position and stays at the fully closed position. Also, the engine speed Ne continues decreasing to the idle speed Neid and reaches the idle speed Neid. The engine speed Ne then stays at the idle speed Neid.

The shift position domain Sa becomes consistent with the shift position command Sr at the timing t32 because the shift position Sd reaches the forward limit Ssf. The throttle valve position THd and the engine speed Ne together start increasing at the timing t32.

In the event that the engine control node 98 does not receive the transferring frame from either the remote controller node 140 or the shift control node 134 within the preset time period, the engine control node 98 recognizes, in conducting the program 256 of FIG. 7 or the program 258 of FIG. 8, respectively, that the further control should not be conducted. The engine control node 98 coercively ends the further control after setting the throttle valve position control value THc to fully closed position (open degree 0%). Thus, the engine 38 cannot operate against the operator's will. Additionally, the abnormal condition of the engine control node 98 can be rapidly found if the control is coercively ends, without using any other measures. The abnormal condition can be called to the attention of the operator by the display unit or the buzzer.

Similarly, in the event that the shift control node 134 does not receive the transferring frame from either the remote controller node 140 or the engine control node 98 within the preset time period, the shift control node 134 recognizes, in conducting the program 264 of FIG. 10 or the program 266 of FIG. 11, respectively, that the further control should not be conducted. The engine shift control node 134 coercively and simply ends the further control. The propeller 112 thus cannot be brought into any mode against the operator's will. Additionally, the abnormal condition of the shift control node 134 can be rapidly noticed by the operator if the control is coercively ended, without using any other measures. The abnormal condition can be called to the operator's attention by the display unit or the buzzer.

As thus described, in the illustrated embodiment, the throttle valve position control value THc is set based upon the throttle valve position command THr when the shift position domain Sa is consistent with the shift position command Sr. On the other hand, the throttle valve position control value THc is set at the fully closed position or open degree 0% when the shift position domain Sa is inconsistent with the shift position command Sr. Thus, the mode change of the propeller 112 by the shift control node 134 occurs at a relatively low engine speed Ne. Also, the mode change to either the forward position F or the reverse position R from the neutral position N occurs when the engine speed Ne is equal to or less than the low engine speed Nes. Accordingly, abnormal mode changes or discomfort shocks are avoided or significantly reduced. In other words, the propeller 112 and the engine 38 are interrelatedly controlled with each other in the embodiment.

In addition, in the mode change to the neutral position N from the forward position F or the reverse position R, the illustrated shift control node 134 starts the change not by the engine speed Ne but when the throttle valve position THd is equal to or less than the adjacent position to fully closed position THs. The mode change to the neutral position N can be rapidly done, accordingly.

The control described above can be applied to types of engines other than the four-cycle engine. For example, the control can be applied to two-cycle engines or rotary engines.

It should be noted that the forward troll position F and the reverse troll position R may have a certain range. The forward acceleration range GF and the reverse acceleration range GR can involve the troll range adjacent to each least accelerated portion.

The steps S26–S32, which represent a kind of filtering process, allow the throttle valve position THd and the engine speed Ne to change gradually or slowly. The change rate of the throttle valve position THd or the engine speed Ne is changeable by varying the preset increase threshold value ÄTHa or the preset decrease threshold value ÄTHd.

In the illustrated embodiment, the transferring frame receiving processes are conducted separately from the throttle valve position setting process or the shift position setting process. However, the transferring frame receiving processes can be combined with the throttle valve position setting process or the shift position setting process.

The network system using a LAN (including CAN) is useful to realize the rapid, smooth and precise communications and controls and also is useful to simplify wiring. However, the respective terminal nodes can be connected with each other by any communication measures. For example, electric wire harnesses can be used. In this variation, the respective nodes can exchange the throttle valve position command THr, the shift position command Sr and other data by electrical signals rather than the transferring frames. Further, the various signals and commands can be transferred wirelessly such as by RF communications.

In addition, the engine control node or unit and the shift control node or unit can be unitarily formed together.

Although this invention has been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the invention have been shown and described, other modifications, which are within the scope of this invention, will be readily apparent to those of skill in the art based upon this disclosure. It is also contemplated that various combination or sub-combinations of the specific features and aspects of the embodiments or variations may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising an propulsion device, an internal combustion engine that powers the propulsion device, a change device that changes the propulsion device between a first mode and a second mode, the propulsion device being powered by the engine in the first mode and not powered by the engine in the second mode, a setting device that sets an engine output of the engine between a minimum level and a maximum level, an operating device that provides a first command that corresponds to either the first mode or the second mode and provides a second command that corresponds to the engine output, a first control device controlling the change device based upon the first command, a second control device controlling the setting device based upon the second command, and a sensing device that senses either the first mode or second mode of the propulsion device to provide a mode signal, the second control device regulating the setting device to set the engine output generally at the minimum level or to lower the engine output generally to the minimum level when the first command from the operating device and the mode signal from the sensing device differ from each other.

2. The watercraft as set forth in claim 1 additionally comprising an air intake device that introduces air to a combustion chamber of the engine, the air intake device having a throttle valve that regulates an amount of the air, the throttle valve moving generally between a fully closed position and a fully open position, the engine output varying in accordance with a position of the throttle valve between the fully closed position and the fully open position, the setting device actuating the throttle valve to set the engine output.

3. The watercraft as set forth in claim 2, wherein the setting device places the throttle valve at an adjacent position located adjacent to the fully closed position to set the engine output generally at the minimum level or moves the throttle valve to the adjacent position to lower the engine output generally to the minimum level.

4. The watercraft as set forth in claim 3 additionally comprising a second sensing device that senses an actual position of the throttle valve to provide a position signal, the first control device allowing the change device to change the propulsion device from the first mode to the second mode based upon the position signal when the throttle valve is placed at the adjacent position.

5. The watercraft as set forth in claim 1 additionally comprising a second sensing device that senses an engine speed of the engine to provide an engine speed signal, the first control device allowing the change device to change the propulsion device from the second mode to the first mode based upon the engine speed signal when the engine speed is equal to or lower than a preset engine speed.

6. The watercraft as set forth in claim 1 additionally comprising a communication network, the operating device, the first control device and the second control device communicate with each other through the communication network.

7. The watercraft as set forth in claim 6, wherein operating device creates pieces of the first command one by one and intermittently transfers each piece of the first command one after another to the first control device, the first control device receives the pieces of the first command and measures an elapse time that elapses between one of the pieces of the first command and another one of the pieces of the first command that immediately follows said one of the pieces of the first command, the first control device creates a notice indicative of an abnormal state and transfers the notice when the elapse time is equal to or greater than a preset time.

8. The watercraft as set forth in claim 6, wherein operating device creates pieces of the second command one by one and intermittently transfers each piece of the second command one after another to the second control device, the second control device receives the pieces of the second command and measures an elapse time that elapses between one of the pieces of the second command and another one of the pieces of the second command that immediately follows said one of the pieces of the second command, the second control device creates a notice indicative of an abnormal state and transfers the notice when the elapse time is equal to or greater than a preset time.

9. The watercraft as set forth in claim 1, wherein the change device includes an electric motor.

10. The watercraft as set forth in claim 1, wherein the setting device includes an electric motor.

11. The watercraft as set forth in claim 1, wherein the propulsion device and the engine are incorporated in a single unit.

12. A watercraft comprising an propulsion device, an internal combustion engine that powers the propulsion device, a change device that changes the propulsion device between a first mode and a second mode, the propulsion device being powered by the engine in the first mode and not powered by the engine in the second mode, a setting device that sets an engine output of the engine between a minimum level and a maximum level, an operating device that provides a first command that corresponds to either the first mode or the second mode and provides a second command that corresponds to the engine output, a first control device controlling the change device based upon the first command, a second control device controlling the setting device based upon the second command, and a sensing device that senses an engine speed of the engine to provide an engine speed signal, the first control device allowing the change device to change the propulsion device from the second mode to the first mode based upon the engine speed signal when the engine speed is equal to or lower than a preset engine speed.

13. The watercraft as set forth in claim 12, wherein the engine speed varies in accordance with the engine output.

14. The watercraft as set forth in claim 12 additionally comprising an air intake device that introduces air to a combustion chamber of the engine, the air intake device having a throttle valve that regulates an amount of the air, the throttle valve moving generally between a fully closed position and a fully open position, and a second sensing device that senses an actual position of the throttle valve to provide a position signal, the first control device allowing the change device to change the propulsion device from the first mode to the second mode based upon the position signal when the throttle valve is placed at an adjacent position located adjacent to the fully closed position.

15. The watercraft as set forth in claim 12 additionally comprising a communication network, the operating device, the first control device and the second control device communicate with each other through the communication network.

16. A watercraft comprising an propulsion device, an internal combustion engine that powers the propulsion device, a changeover mechanism that changes the propulsion device between a first mode and a second mode, the propulsion device being powered by the engine in the first mode and not powered by the engine in the second mode, an air intake device that introduces air to a combustion chamber of the engine, the air intake device having a throttle valve that regulates an amount of the air, a throttle valve actuator actuating the throttle valve between a fully closed position and a fully open position, an operating device that provides a first command that corresponds to either the first mode or the second mode and provides a second command that corresponds to a position of the throttle valve, a first control device controlling the changeover mechanism based upon the first command, a second control device controlling the throttle valve actuator based upon the second command, and a sensing device that senses either the first mode or second mode of the propulsion device to provide a mode signal, the second control device regulating the throttle valve actuator to place the throttle valve at an adjacent position located adjacent to the fully closed position or to move the throttle valve to the adjacent position when the first command and the mode signal differ from each other.

17. The watercraft as set forth in claim 16 additionally comprising a second sensing device that senses an actual position of the throttle valve to provide a position signal, the first control device allowing the change device to change the propulsion device from the first mode to the second mode based upon the position signal when the throttle valve is placed at the adjacent position.

18. The watercraft as set forth in claim 16 additionally comprising a second sensing device that senses an engine speed of the engine to provide an engine speed signal, the first control device allowing the changeover mechanism to change the propulsion device from the second mode to the first mode based upon the engine speed signal when the engine speed is equal to or lower than a preset engine speed.

19. The watercraft as set forth in claim 16 additionally comprising a communication network, the operating device, the first control device and the second control device communicate with each other through the communication network.

20. A control method for a watercraft having a propulsion device and an engine, the method comprising operating a change device that changes the propulsion device between a first mode and a second mode based upon a first command that corresponds to either the first mode or the second mode, the propulsion device being powered by the engine in the first and not powered by the engine in the second mode, operating a setting device that sets an engine output of the engine between a minimum level and a maximum level based upon a second command that corresponds to the engine output, sensing either the first mode or the second mode of the propulsion device to provide a mode signal, determining whether the first command and the mode signal differ from each other, and setting the engine output generally at the minimum level or lowering the engine output generally to the minimum level when the first command and the mode signal differ from each other.

21. The control method as set forth in claim 20 additionally comprising sensing an engine speed of the engine to provide an engine speed signal, determining whether the engine speed is equal to or lower than a preset engine speed based upon the engine speed signal, and allowing the change device to change the propulsion device from the second mode to the first mode.

22. A control method for a watercraft having a propulsion device and an engine, the method comprising operating a change device that changes the propulsion device between a first mode and a second mode based upon a first command that corresponds to either the first mode or the second mode, the propulsion device being powered by the engine in the first and not powered by the engine in the second mode, operating a setting device that sets an engine output of the engine between a minimum level and a maximum level based upon a second command that corresponds to the engine output, sensing an engine speed of the engine to provide an engine speed signal, determining whether the engine speed is equal to or lower than a preset engine speed based upon the engine speed signal, and allowing the change device to change the propulsion device from the second mode to the first mode when the determination is positive.

23. A control method for a watercraft having a propulsion device and an engine, the method comprising operating a change device that changes the propulsion device between a first mode and a second mode based upon a first command that corresponds to either the first mode or the second mode, the propulsion device being powered by the engine in the first and not powered by the engine in the second mode, operating a throttle valve actuator that actuate a throttle valve that regulates an amount of air to a combustion chamber of the engine to move generally between a fully closed position and fully open position based upon a second command that corresponds to a position of the throttle valve, sensing either the first mode or the second mode of the propulsion device to provide a mode signal, determining whether the first command and the mode signal differ from each other, and placing the throttle valve at an adjacent position located adjacent to the fully closed position or moving the throttle valve to the adjacent position when the first command and the mode signal differ from each other.

24. The control method as set forth in claim 23 additionally comprising sensing an actual position of the throttle valve, determining whether the throttle valve is placed at the adjacent position based upon the sensed actual position, and allowing the change device to change the propulsion device from the first mode to the second mode when the throttle valve is placed at the adjacent position.

25. The control method as set forth in claim 23 additionally comprising sensing an engine speed of the engine to provide an engine speed signal, determining whether the engine speed is equal to or lower than a preset engine speed based upon the engine speed signal, and allowing the change device to change the propulsion device from the second mode to the first mode when the engine speed is equal to or lower than a preset engine speed.

26. A system for controlling the throttle valve position and shift mode of an engine of a watercraft engine so as to reduce abrupt engine speed and shift mode transitions, the system comprising: an operator control device that generates throttle valve position and shift mode control signals in response to actions of an operator; and a control circuit that controls the throttle valve position and the shift mode of the engine based on the throttle valve position and shift mode control signals generated by the operator control device, and based further on data indicative of an actual shift mode and throttle valve position of the engine; wherein the control circuit controls a rate of change of the throttle valve position to inhibit abrupt engine speed transitions, and wherein the control circuit further delays operator-commanded transitions in the engine's shift mode as needed to allow the throttle valve to be placed in an approximately closed state before such shift mode transitions occur.

27. The system of claim 26, wherein the control signals generated by the operator control device are communicated to the control circuit as commands.

28. The system of claim 27, wherein the commands are communicated to the control circuit over a local area network of the watercraft.

29. The system of claim 26, wherein the control circuit comprises at least one processing unit that executes a control program.

* * * * *

UNITED STATES PATENT AND TRADEMARK OFFICE

CERTIFICATE OF CORRECTION

PATENT NO. : 6,863,580 B2
APPLICATION NO. : 10/624204
DATED : March 8, 2005
INVENTOR(S) : Takashi Okuyama It is certified that error appears in the above-identified patent and that said Letters Patent is hereby corrected as shown below:

At Page 2, Column 2, Line 2, please delete "entitiled" and insert therefore, --entitled--.

At Page 2, Column 2, Line 5, after "Oct." please delete "24,2002," and insert therefore, --24, 2002,--.

At Page 2, Column 2, Line 7, please delete "Kabishiki" and insert therefore, --Kabushiki--.

At Page 2, Column 2, Line 8, please delete "US application No:" and insert therefore, --U.S. Appl. No.:--.

At Page 2, Column 2, Line 11, please delete "US application No:" and insert therefore, --U.S. Appl. No.:--.

At Column 12, Line 51, after "NETWORK," please insert therefore, --which Attorney's docket number is FS.20107US0A,--.

Signed and Sealed this

Twelfth Day of December, 2006

JON W. DUDAS
*Director of the United States Patent and Trademark Office*